US010703539B2

(12) United States Patent
Deutschle et al.

(10) Patent No.: US 10,703,539 B2
(45) Date of Patent: Jul. 7, 2020

(54) SUPPORTING STRUCTURE FOR CONCURRENTLY SUPPORTING A PLURALITY OF VIALS, USE THEREOF AND PROCESS FOR THE TREATMENT OF SUCH VIALS

(71) Applicant: SCHOTT AG, Mainz (DE)

(72) Inventors: Gregor Fritz Deutschle, Idstein (DE); Edgar Pawlowski, Stadecken-Elsheim (DE)

(73) Assignee: SCHOTT AG, Mainz (DE)

( * ) Notice: Subject to any disclaimer, the term of this patent is extended or adjusted under 35 U.S.C. 154(b) by 0 days.

(21) Appl. No.: 15/825,769

(22) Filed: Nov. 29, 2017

(65) Prior Publication Data

US 2018/0148222 A1 May 31, 2018

(30) Foreign Application Priority Data

Nov. 30, 2016 (DE) ..... 10 2016 123 147

(51) Int. Cl.
*B65D 25/10* (2006.01)
*B01L 9/06* (2006.01)
(Continued)

(52) U.S. Cl.
CPC ..... *B65D 25/108* (2013.01); *A61J 1/16* (2013.01); *B01L 9/06* (2013.01); *B65D 85/30* (2013.01);
(Continued)

(58) Field of Classification Search
CPC ..... A61J 1/16; A61J 1/065; B65D 25/108; B65D 25/10; B01L 9/06
(Continued)

(56) References Cited

U.S. PATENT DOCUMENTS 3,643,812 A * 2/1972 Mander ..... B01L 9/06 211/74
5,128,105 A * 7/1992 Berthold ..... B01L 9/06 422/561
(Continued)

FOREIGN PATENT DOCUMENTS

CN 102057268 5/2011
DE 102012103899 A1 11/2013
(Continued)

OTHER PUBLICATIONS

Selch, "Nested Vials for Improved Lyophilization Efficiency", Apr. 6, 2015, 4 pages.

*Primary Examiner* — Steven A. Reynolds
(74) *Attorney, Agent, or Firm* — Ohlandt, Greeley, Ruggiero & Perle, L.L.P.

(57) ABSTRACT

A supporting structure for concurrently supporting a plurality of vials is provided. The supporting structure includes a carrier having apertures or receptacles, into which the vials can be inserted to be supported therein on the carrier. The vials have a bottom that forms a base, a cylindrical side wall, and an annular transition region between the base and the cylindrical side wall. The carrier has a retaining protrusion at a lower end of the aperture or receptacle that extends into the respective aperture or receptacle inward in radial direction. The retaining protrusion supports the vial in cooperation with the transition region outside the base in such a manner that the bottoms or bases of the vials jut out of the apertures or receptacles of the carrier and are freely accessible from the lower side of the carrier.

38 Claims, 20 Drawing Sheets

(51) Int. Cl.
*A61J 1/16* (2006.01)
*B65D 85/30* (2006.01)
*A61J 1/06* (2006.01)

(52) U.S. Cl.
CPC ..... *A61J 1/065* (2013.01); *B01L 2200/025* (2013.01); *B01L 2300/0829* (2013.01); *B01L 2300/0835* (2013.01)

(58) Field of Classification Search
USPC ..... 206/370, 477, 478
See application file for complete search history.

(56) References Cited

U.S. PATENT DOCUMENTS 5,452,810 A * 9/1995 Schwartz ..... B01L 9/06 206/446
6,164,044 A * 12/2000 Porfano ..... B65B 55/10 422/28
7,448,493 B2 * 11/2008 Wong ..... B65D 71/50 206/151
8,100,263 B2 1/2012 Vanderbush
8,118,167 B2 * 2/2012 Togashi ..... A61M 5/008 206/519
8,485,357 B2 * 7/2013 Song ..... A61M 5/002 206/366
8,561,828 B2 * 10/2013 Krauss ..... A61J 1/16 206/564
9,718,583 B2 * 8/2017 Nicoletti ..... A61M 5/002
9,828,124 B2 * 11/2017 Wissner ..... F26B 5/06
2001/0052476 A1 12/2001 Heinz
2002/0108917 A1 8/2002 Maruyama
2007/0116613 A1 5/2007 Elsener
2007/0151882 A1 * 7/2007 Cocheteux ..... A61M 5/008 206/366
2009/0065458 A1 3/2009 Murray
2010/0203643 A1 * 8/2010 Self ..... B01L 9/06 436/47
2011/0123416 A1 5/2011 Giraud
2012/0118777 A1 * 5/2012 Kakiuchi ..... A61M 5/002 206/366
2013/0048531 A1 * 2/2013 Nicoletti ..... A61M 5/002 206/557
2013/0236276 A1 9/2013 Richter
2014/0008249 A1 1/2014 Müller
2014/0027332 A1 * 1/2014 Pawlowski ..... B01L 9/06 206/438
2015/0089830 A1 4/2015 Wissner
2015/0108020 A1 * 4/2015 Iwase ..... A61M 5/008 206/365
2015/0166212 A1 6/2015 Wissner
2015/0376562 A1 12/2015 Baum
2016/0130022 A1 5/2016 Wissner
2016/0318660 A1 11/2016 Wissner

FOREIGN PATENT DOCUMENTS

EP 2183166 10/2014
WO 2009015862 2/2009
WO 2010062602 6/2010
WO 2011135085 11/2011
WO 2013181552 12/2013
WO 2014130349 8/2014
WO 2016075647 5/2016
WO 2016111698 7/2016
WO 2016166769 10/2016

* cited by examiner

SUPPORTING STRUCTURE FOR CONCURRENTLY SUPPORTING A PLURALITY OF VIALS, USE THEREOF AND PROCESS FOR THE TREATMENT OF SUCH VIALS

CROSS REFERENCE TO RELATED APPLICATIONS

The present application claims the benefit under 35 U.S.C. § 119(a) of German Application No. 10 2016 123 147.9 filed on Nov. 30, 2016, the whole content of which is hereby incorporated by reference.

BACKGROUND

1. Field of the Invention

The present invention relates generally to the treatment of containers for substances for pharmaceutical, medical or cosmetic applications, and relates more particularly to a supporting structure for concurrently supporting a plurality of vials, uses thereof and a process for the treatment of such vials, particularly for a freeze-drying (lyophilization) of substances for pharmaceutical or medical applications.

2. Description of Related Art

Vials are widely used as containers for storage of medical, pharmaceutical or cosmetic preparations with administration in liquid form, particularly in pre-dosed quantities. These generally have a cylindrical shape, can be produced from plastics or from glass and can be produced at low costs and in large quantities. For enabling a filling of the vials at low costs under sterile conditions and a long-term storage increasingly lyophilizing processes are used after filling. To this end, the vials need to be unpacked under sterile conditions and then further processed at the pharmaceutical filler or pharmaceutical company. However, there exist hardly packaging solutions for vials enabling a lyophilization of vials supported on a nest and/or within the package.

Such supporting structures are disclosed in WO 2009/015862 A2, WO 2011/135085 A1 and WO 2013/181552 A2. These supporting structures do not allow, however, a free access to the bottoms of the containers while they are supported on the supporting structure.

A direct contact between a cooling plate and the bottoms of vials is important for an optimized, quick lyophilization process, which requires that the bottoms of the vials are easily accessible.

US 2015/0166212 A1 of the Applicant discloses a supporting structure according to the preamble of claim 1, wherein the supporting means comprise at least two supporting tongues which are provided on the edge of a respective aperture or receptacle and which are configured such that these are pivoted away or folded back elastically into the apertures or receptacles during insertion of the containers and which are matched such to the vials that the vials are supported with radial play by the supporting tongues. The bottoms of the vials are freely accessible from the underside of the supporting structure, which makes it possible to carry out a lyophilization process while the vials are supported on the supporting structure.

However, the supporting tongues of the supporting structure are not always sufficiently stable, particularly for supporting large and heavy vials. Furthermore, a certain material abrasion occurs between the supporting tongues upon insertion of the vials, which is not desirable. The supporting tongues must be formed precisely and with relatively tight tolerances to ensure that the vials can be supported with play as desired. However, the carrier may warp in use due to process parameters, such as temperature or humidity, so that the relatively tight tolerances cannot be fulfilled and thus a comparatively large, undesirable material abrasion occurs.

In the supporting structure, the necks of the vials are not freely accessible. For many process steps, such as weighing, filling, stoppering or crimping of metal lids, the vials thus need to be lifted, which requires special process equipment.

According to the prior art, for being processed further the vials need to be removed from the supporting structure or inserted into it by means of robots or automated gripping devices. However, since a certain friction exists between the vials and the supporting means of the supporting structure, it is difficult to remove or insert all vials concurrently because otherwise relatively large forces would act on the supporting structure, which might result, for example, in an uncontrolled warping of the supporting structure or even cause that the vials accidentally fall out of the supporting structure. Therefore, according to the prior art only a subset of the vials is typically removed or inserted by means of a robot or gripping device, wherein the total number of vials of this subset then depends on what forces the supporting structure can withstand without an excessive warping. This results in delays and higher costs in the further processing of the vials.

DE 102012103899 A1 of the Applicant discloses another supporting structure for pharmaceutical containers, in which all the side walls of the receptacles of the supporting structure can be adjusted in a coordinated manner between a first position and a second position, wherein the containers can be inserted into the apertures or receptacles or displaced therein with little effort in the first position and wherein the containers are fixed in the receptacles by friction in the second position. In order to prevent slipping of the containers during insertion into the receptacles, the containers need to be supported on an additional supporting surface, as long as the supporting structure is not transferred into the second position. The containers may undergo a lyophilization process while being supported on the supporting structure.

US 2001/0052476 A1 of the Applicant discloses a supporting plate made of an elastic material having apertures where the containers are clamped while the bottoms are freely accessible from the underside of the supporting plate. However, it is difficult to ensure that the bottoms of all the containers are supported exactly at the same distance to the supporting plate, making a uniform thermal contact with a cooling surface impossible. For this purpose, all the containers would have to be adjusted individually in axial direction against the clamping force in the apertures.

WO 2016/075647 A1 discloses a lyophilization process in which the bottoms of the containers are just not in direct contact with a cooling surface.

WO 2016/166769 A1 discloses a supporting structure for supporting pre-crimped cartridges. As shown in FIG. 6*a*, annular projections are formed at the lower ends of the receptacles, on which the shoulders of the cartridges are supported without the crimped caps resting in this region. The ends of the cartridges protrude out of the receptacles while the cartridges are supported. A supporting of vials is not disclosed.

WO 2010/062602 A1 discloses the supporting of a plurality of plugs. The supporting of vials is not disclosed.

EP 2 183 166 B1 discloses the supporting of vials in such a manner that the bottoms of the vials, which are supported on the supporting structure, are freely accessible from the underside of a carrier. However, the vials are always supported at their upper ends, i.e. in the region of the necks of the vials.

US 2013/0048531 A1 discloses a supporting structure for vials, wherein radial retaining protrusions at the lower ends of the receptacles support the bottoms of the vials. The bottoms of the vials, which are supported on the carrier, are not freely accessible in the sense of the present application.

U.S. Pat. No. 8,561,828 B2 discloses a further supporting structure for vials, wherein radial retaining protrusions at the lower ends of the receptacles support the bottoms of the vials. The bottoms of the vials, which are supported on the carrier, are not freely accessible in the sense of the present application.

SUMMARY

It is an object of the present invention to provide an enhanced supporting structure for concurrently supporting a plurality of vials that enables a simple processing of the vials, in particular a freeze-drying process (lyophilization), while the vials are supported on a supporting structure. Furthermore, a corresponding transport or packaging container comprising such a supporting structure, a corresponding use of such a supporting structure and a process for freeze-drying a substance for pharmaceutical or medical applications in vials is to be provided.

According to the present invention, there is provided a supporting structure for concurrently supporting a plurality of vials, comprising a carrier having an upper side, a lower side opposite to the upper side, and a plurality of apertures or receptacles into which the vials can be inserted at least partially to be supported therein at the carrier, wherein the vials have a bottom, which forms a base, a cylindrical side wall and an annular transition region between the base and the cylindrical side wall. According to the present invention, at least one retaining protrusion protrudes radially inward into the respective aperture or receptacle at the lower end of a respective aperture or receptacle for supporting the associated vial in cooperation with the transition region and outside the base in such a manner that the bottoms or bases of the vials jut out of the apertures or receptacles of the carrier and are freely accessible from the lower side of the carrier.

Vials in the sense of the present invention serve as a preferred embodiment for such containers for accommodating and storing of substances for pharmaceutical or medical applications. The transition region of the vials is preferably a curved edge portion at a transition region between the respective bottom or base and the cylindrical side wall of a vial, which is located outside the base of the vial. The base of a vial is defined as the contact surface of the vial when it rests upright on a flat supporting surface. If the bottom of a vial is planar, this contact surface is circular and represents the bottom-most portion of a vial if viewed in an axial longitudinal section. If the bottom of a vial is concave, this contact surface is annular and is formed by the bottom vertices of the vial, which form a ring if the vial is viewed in a plan view from below.

Because the retaining protrusions cooperate with only these transition regions, according to the present invention the bottoms or bases of the vials are freely accessible, which allows in particular to carry out a freeze-drying process while the vials are supported on the supporting structure.

Because the vials are supported at the transition regions, according to the present invention particularly no undesired material abrasion takes place at the upper ends of the vials so that the ingress of contaminants via the filling openings at the upper ends of the vials can be prevented more effectively. If such a material abrasion should nevertheless take place, it will take place in the region of the lower ends of the vials and this material abrasion can be removed again in a further processing step in an advantageously simple manner due to the design of the supporting structure, as explained below.

According to the present invention the vials jut out of the apertures or receptacles only over a distance, which corresponds to an axial length of the retaining protrusions (in a direction perpendicular to a plane spanned by the carrier). This distance may range from about and including 0.01 to 5.0 mm, preferably from about and including 0.01 to 2.0 mm, so that only small axial adjustment distances are required in order to enable a full-surface contact of the bottoms or bases of the vials with a cooling surface by simply lowering of the supporting structure by a few millimeters or by less than a millimeter, for example for carrying out a freeze-drying process, so that the vials then rest freely with their bottoms or bases on the cooling surface during the actual lyophilization process. Here, the supporting structure can be kept even further apart from the cooling surface, which further reduces the thermal mass during the lyophilization process. However, the supporting structure may also be simply lowered to the cooling surface for the lyophilization process. The same applies to other processes that require a free access to the bottoms or bases of the vials.

Because the vials are supported at their lower ends, not only the lower ends of the vials, thus in particular the bottoms or bases, but also the upper ends of the containers, in particular the constricted neck portions or the filling openings, are freely accessible, while the vials are supported on the supporting structure, because a further support in this region is not required according to the present invention. For many process steps, such as weighing, filling, stoppering or crimping, it is not necessary according to the present invention to lift the vials, which helps to further reduce the efforts in the processing of vials.

According to the present invention only small forces prevail at the retaining protrusions, so that the retaining protrusions may enable a self-centering of the vials in the apertures or receptacles, especially if the retaining protrusions are formed as circumferential protrusions or arranged as a plurality of protrusions disposed in an appropriate symmetrical arrangement along the lower ends of the apertures or receptacles.

There exist no particular limitations regarding the shape of the retaining protrusions. These only need to enable a supporting of the vials at the edge portions. Conceivable are thus flat protrusions extending exactly horizontally (in parallel with the plane spanned by the carrier of the supporting structure) and radially inward, but also beveled, concave or convex retaining protrusions or retaining protrusions having several supporting steps. What is important is only that engagement with edge portions or transition regions of the vials 'above' the bottoms or bases of the vials is possible, more preferably exclusively within a transition region between the bottoms or bases and cylindrical side walls of the vials, thus for example within the curved transition region. This also automatically results in a positioning of the cylindrical side walls of the vials at a certain distance to the side walls of the apertures or receptacles of the supporting structure, i.e. that a radial play is present in the region of the cylindrical side walls, which further promotes the aforementioned self-centering of the vials in the apertures or receptacles, but also enables an insertion of the vials without friction from the upper side of the carrier into the apertures or receptacles of the supporting structure, which reliably prevents the aforementioned material abrasion.

According to a preferred further embodiment, the retaining protrusions are matched to the shape and dimensions of the transition regions of the vials in such a manner that the transition regions are supported in by a positive-fit engagement, but not by friction. This reliably prevents the aforementioned undesirable abrasion of material at the retaining protrusions. A suitable positive-fit only requires that the retaining protrusions protrude sufficiently far in radial direction in order to engage with the aforementioned transition regions or edge portions of the vials to a sufficient extent. A coating having a relatively high coefficient of friction, for example of a plastic material, which may also be sprayed on using a two-component (2K) injection molding process, may be provided on the retaining protrusions, in particular at their front ends to prevent accidental slippage of the vials. A suitable positive-fit can be ensured in a simple manner in particular when the front ends of the retaining protrusions are matched with tight tolerances to the specific geometry of the edge portions of the vials.

Since the above-mentioned transition regions of vials are curved with a predetermined radius of curvature, which is subject to relatively tight tolerances, the retaining protrusions facing these edge portions may also be formed concavely curved at least partly, preferably with a radius of curvature corresponding to the radius of curvature of the aforementioned edge sections of the vials.

According to a preferred embodiment, the surfaces of the retaining protrusions, which face a respective transition region of a vial, are slanted at least partially toward the lower side of the carrier. Conveniently, the inclination angle corresponds to the inclination angle of a tangent to the transition region of the vials approximately in the region midway between the bottoms or bases and the cylindrical side walls, if viewed in a side view. In particular, this inclination angle can thus be in the range of about 45 degrees.

However, this inclination angle depends particularly on the size of the radius of curvature of the transition regions, and is subject to a compromise between the two requirements, on the one hand that the bottoms or lower ends of the vials should jut out the apertures or receptacles as far as possible for an easy access, on the other hand that a reliable supporting of the vials must be ensured at the transition regions under all possible process conditions, in particular by means of a positive-fit; at the same time a sufficient radial play must exist between the side walls of the vials and the side walls of the apertures or receptacles of the supporting structures while the vials are inserted and supported. The optimum inclination angle for this purpose can be calculated by simple calculations and numerical optimization in accordance with the specific geometry of the aforementioned edge portions. Thus, the surfaces of the retaining protrusions facing the edge portions are slanted toward the lower side of the carrier at a predetermined angle to a line perpendicular to a plane spanned by the carrier, said predetermined angle being preferably in the range between 10 and 70 degrees, more preferably in the range between 20 and 50 degrees, According to a preferred further embodiment straight portions are formed at front ends of the retaining protrusions extending perpendicular to a plane spanned by the carrier. These portions extending in axial direction are thus arranged below the actual retaining protrusions and effectively serve a sufficient reinforcement of the retaining protrusions in order to prevent undesired bending of the retaining protrusions, which would result in an undesirable slippage of the vials. This axial length mainly depends on the stiffness of the material of the retaining protrusions and of the carrier or of the side walls of the carrier, and on the weight and on the exact geometry of the aforementioned transition region of the vials to be supported, and can be calculated and optimized in a simple manner. Conveniently, the axial length of the aforementioned straight portions of the retaining protrusions in a direction perpendicular to the plane spanned by the carrier is in the range from 0.1 and 5.0 mm, preferably in the range from 0.1 to 2.0 mm, which depends particularly on the stiffness the material of the retaining protrusions and of the carrier or of the side walls of the carrier.

The predetermined radius of curvature of the transition regions of the vials is subject to very tight tolerances due to standards and general specifications of the manufacturers, and is usually in the range between 1.0 and 10.0 mm, more preferably in the range between 1.5 and 4.0 mm. According to a further embodiment, for this purpose the retaining protrusions are matched to the shape of the transition regions of the vials in such a manner that the bottoms or bases of the vials jut out of the apertures or receptacles of the carrier by a distance in the range between 0.01 and 5.0 mm, more preferably in the range between 0.01 and 2.0 mm. According to the present invention this enables advantageously short adjustment distances of the containers if the vials should be accessible without forces, for example if the vials shall rest freely on a cooling surface. Thus, according to the present invention even shorter processing times are possible.

According to a further embodiment, the retaining protrusion at the lower end of a respective aperture or receptacle is circumferential. According to a further alternative embodiment at least two retaining protrusions are formed at the lower ends of the apertures or receptacles at equiangular distances to each other, wherein a circumferential length of gaps between two adjacent retaining protrusions of an aperture or receptacle is respectively smaller than a circumferential length of the respective retaining protrusions. The symmetry of the supporting of the vials, which is thus possible, favors self-centering effects when supporting the vials in the apertures or receptacles of the supporting structure. Thus, the vials can be positioned and aligned even more accurately, in particular in such a manner that the bottoms of all vials are accurately aligned horizontally with horizontal orientation of the carrier, i.e. in parallel with a horizontal cooling surface of a freeze-dryer.

According to a further embodiment the receptacles are formed such that upper ends of the vials do not protrude beyond the upper side of the carrier. Hence, the vials can be accommodated in the receptacles fully protected against mechanical action. Here, the upper ends of the vials may then be arranged substantially flush with the plane defined by the upper side of the carrier or at a very short distance therefrom, if the transition regions are supported on the retaining protrusions, wherein this distance may be smaller than the aforementioned distance by which the bottoms or bases of the vials jut out of the apertures or receptacles in the supporting position. Thus, by means of a simple axial displacement of the supporting structure by this distance towards a supporting surface disposed below the supporting structure it can be ensured after a treatment of the vials, that the upper ends of the vials jut out of the receptacles of the supporting structure by this distance, which may facilitate a gripping of the vials by means of robots or gripping devices or a further processing of the upper ends of the vials, for example a stoppering and/or the crimping of a metal cap with septum.

According to a further embodiment, the receptacles are formed by circumferential side walls, which enables an even better mechanical protection of the side walls of the vials. As will be explained in more detail below with reference to a process according to the present invention, further interspaces may be formed between the side walls of directly adjacent receptacles into which cooling fingers may project. Preferably, the retaining protrusions at the lower ends of the side walls are formed integrally therewith, in particular by means of a plastic injection molding process, which reduces manufacturing costs and enhances the mechanical reliability of the supporting structure, but which also enables a higher degree of precision in the manufacturing of the supporting structure, in particular the compliance with very tight tolerances.

According to a further embodiment, slots are formed at the lower ends and on opposite sides of the side walls of the receptacles. Height adjustment devices, which may be for example strip-shaped, may engage with these slots, which height adjustment devices are arranged underneath the bottoms of the vials and in alignment with these slots and may lift the vials by suitable height adjustment in order to facilitate the removal and insertion of the vials out of and into the receptacles of the supporting structure. Or the slots enable a bending of the supporting structure and thereby a widening of the lower ends of the slots whereby the vials may be 'released' downward.

According to an alternative further embodiment, the carrier is formed as a flat, relatively thin supporting plate, in which the apertures are directly formed, wherein the retaining protrusions are formed integrally with the supporting plate at the lower ends of the apertures, particularly by means of a plastic injection molding process. In this embodiment the vials are generally not laterally guided and secured while being supported on the supporting structure. However, depending on the process conditions, this may be sufficient, in particular if it can be assumed that no significant forces act on the vials in radial direction during their treatment. In this alternative embodiment an optimum accessibility of virtually all portions of the vials is ensured.

If a lateral support of the vials should be desired while these are supported on the supporting structure and/or when these are inserted into or removed out of the apertures of the supporting structure, according to a further embodiment guiding members may be disposed on the upper side of the supporting plate at least in sections along edges of the apertures, which extend perpendicular to the upper side of the supporting plate in order to prevent contact of vials, which are supported in directly adjacent apertures. These guiding members may, for example, be provided as vertical pins or plates at the edge of the apertures on the upper side of the carrier, conveniently arranged at equiangular distances to each other. Here, interspaces between these guiding members may continue to allow access to the side walls of the vials while these are supported on the supporting structure.

According to a preferred further embodiment, the apertures or receptacles are matched to an outer diameter of the vials supported therein, that a radial play exists above the afore-mentioned edge portions of the vials, i.e. to the side walls of the apertures or receptacles. According to the present invention this radial play enables a displacement of the vials inside the receptacles at low forces and completely without friction in a direction perpendicular to the upper side of the carrier, i.e. in the axial direction of the vials, which is further facilitated by the supporting of the vials exclusively by means of a positive-fit of the aforementioned transition regions or edge portions of the vials with the retaining protrusions. The vials may thus be axially displaced already when exposed to very low forces, i.e. may be lifted and lowered again inside the apertures or receptacles of the supporting structure. For this purpose, pressure pulses of low strength caused by a fluid (gas and/or liquid) may be sufficient. By placing a nozzle of suitable shape below the apertures or receptacles, the vials may thus be lifted and lowered again in the apertures or receptacles in a controlled manner.

It is of particular advantage for this purpose if the vials are accommodated in receptacles of the supporting structure, which are formed by circumferential or substantially circumferential side walls extending over a certain length of the vials, for example over at least 50% of the length of the vials, or over the entire length of the vials, forming a relatively narrow annular gap with the side walls of the containers. Since the fluid flow can only escape via the relatively narrow annular gap at the upper ends of the receptacles, even relatively weak fluid flows may displace even heavy or long vials in axial direction.

Because the vials are also guided and secured in radial direction inside the receptacles of the supporting structure, according to the present invention such a fluid flow may be used not only for lifting vials but also for cleaning the outer surfaces of the vials, while the vials are accommodated and supported in the receptacles. The aforementioned relatively narrow annular gap between the side walls of the receptacles and the side walls of the vials causes an increase of the cleaning effect, because the cleaning fluid (liquid, gas or sprayed cleaning liquid) is only allowed to flow within the annular gap, but cannot escape in an uncontrolled manner to the environment. It is of particular advantage when the vials are sealed at their upper ends before such a cleaning step, for example by placing a plug. Such a cleaning step may be, for example necessary for safety reasons after the filling of certain drugs (for example cytostatic drugs).

Such gas-pressure pulses which act from the lower side of the supporting structure, may also be used for removing the vials in this process, by lifting the vials to a sufficient extent, until their upper ends can then be gripped by a robot, a gripping device or the like, and the vials then can be taken out.

However, comparable gas-pressure pulses acting from above the supporting structure may also be used to push the containers downwards out of the receptacles. For this purpose, the gas pressure pulses need act sufficiently intensive on the upper ends of the vials so that the supporting force exerted by the retaining protrusions is overcome, optionally while the retaining protrusions and/or the lower ends of the side walls of the receptacles of the supporting structure are elastically widened or spread apart. For further enhancing gas-pressure pulses, which act on the vials from above, it may be of advantage for the above reasons, if the axial length of the receptacles is larger than the axial length of the containers.

Similar fluid flows may also act on the upper sides of the vials for cleaning purposes, while these are accommodated in the receptacles and supported on the supporting structure, for cleaning the upper sides but also the other outer surfaces of the vials. For this purpose, it is of course of advantage if the vials are sealed at their upper ends before such a cleaning step, for example by placing a plug.

However, corresponding fluid flows or fluid pressure pulses may also act on the upper and/or lower ends of the vials when the filling openings of the containers are not yet sealed at their upper ends and while the vials are supported on the supporting structure, for example for cleaning the inner surfaces of the vials. Of course, for the purpose of a cleaning of the inner volumes of the vials also a nozzle or a tube may be introduced via the filling opening into the interior of the vials for more effectively injecting a cleaning fluid into the interior of the containers.

A further aspect of the present invention relates to the use of a supporting structure as disclosed in the present application, for concurrently supporting a plurality of containers for substances for pharmaceutical or medical applications, for example during their treatment in a processing apparatus, in particular during a freeze-drying process (lyophilization), A further aspect of the present invention is directed to a computer-readable or processor-readable data file, also for transmission over networks, such as a company's internal computer network or over the Internet, comprising instructions or control commands which, when loaded by a computer or by a processor, cause a 3D-printer to print a three-dimensional supporting structure as disclosed in the present application under control of the computer or processor of a suitable material, particularly of a plastic material.

A further aspect of the present invention relates to a transport or packaging container for a plurality of vials, wherein the transport or packaging container is box-shaped and wherein a supporting structure, as disclosed in the present application, is accommodated inside the box-shaped transport or packaging container for supporting the plurality of vials inside the transport or packaging container.

A further aspect of the present invention relates to a method for the treatment or processing of vials having a bottom, which forms a base, a cylindrical side wall and an annular transition region between the base and the cylindrical side wall, comprising the steps of: providing a supporting structure as disclosed in the present application; disposing the vials in the apertures or receptacles of the supporting structure so that the vials are supported outside of the bases by the cooperation of the transition regions with the retaining protrusion in such a manner that the bottoms or bases of the vials jut out of the apertures or receptacles of the carrier and are freely accessible from the lower side of the carrier; and treatment of the vials while being supported at the supporting structure and while being accommodated in the apertures or receptacles.

Preferably, the treatment of the vials comprises one or more of the following: freeze-drying (lyophilization) of a substance for pharmaceutical or medical applications inside the vials; axial displacement of the vials in the apertures or receptacles by the action of a fluid flow, acting on the bottoms or upper ends of the vials; cleaning of outer sides of the vials by means of a fluid flow flowing through a lower end or upper end into the receptacles of the supporting structure; drying the outer sides of the vials by means of a gas flow which flows through a lower end or upper end into the receptacles of the supporting structure.

Due to the advantageous supporting of the vials, a direct contact of the bottoms of all vials that are supported on the supporting structure with a cooling surface, a simple axial displacement and a simple cleaning of outer surfaces of the vials and a simple drying of outer surfaces of the vials may be accomplished, as outlined above.

According to a further embodiment, interspaces are formed between the side walls of directly adjacent receptacles of the supporting structure, into which cooling fingers project, which surround the receptacles of the supporting structure at least in sections. Thus, the cooling of the vials can be performed more effectively and a freeze-drying of the substance contained in the vials can be carried out even more quickly and efficiently.

If the bottoms of the vials are flat and planar, the cooling surface is also flat and planar, so that the bottoms of the vials can rest on the at least one cooling surface over the entire surface during lyophilization. If the bottoms of the vials are concavely curved or of a planar configuration, a gap may also exist between the at least one cooling surface and the associated bottoms of the vials during lyophilization, which may also be implemented in the latter case by means of concave depressions on the upper side of the cooling surface. If the bottoms of the vials are concave, also respective convex projections may be formed on the upper side of the cooling surface on which the concave bottoms of the vials rest directly.

BRIEF DESCRIPTION OF THE DRAWINGS

Hereinafter, the invention will be described by way of example and with reference to the accompanying drawings, from which further features, advantages and problems to be solved may become apparent. In the drawings.

Throughout the drawings, identical reference numerals designate identical or substantially equivalent elements or groups of elements.

DETAILED DESCRIPTION

Figure 1B:
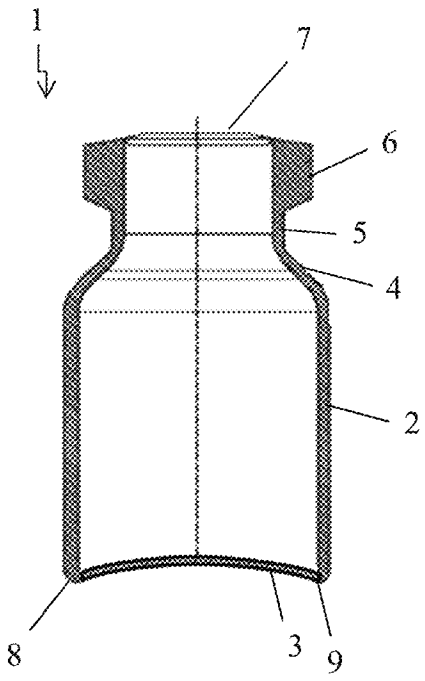
FIGS. 1*a* and 1*b* show the typical geometry of vials as a preferred example of a pharmaceutical container, which is used for a supporting structure or a method according to the present invention.
Figure 1A:
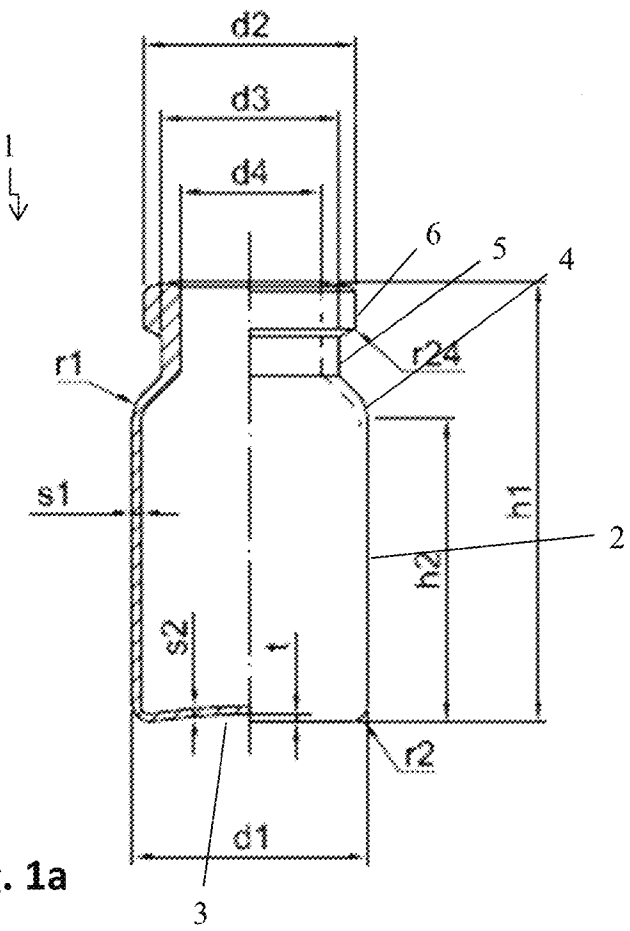

FIG. 1*a* shows the geometry of typical 2R-Vials to 50R-Vials (with a capacity of 4 ml to 62 ml), which is summarized in Table 1 below.

TABLE 1 typical geometry of 2R-vials to 50R-vials

| Type | volume [ml] | tolerance | a [mm] | d1 mm | tolerance | d2 mm | d3 mm max. | d4 mm | h1 mm | tolerance | h2 mm min. | h3 mm | tolerance | r1 mm≈ | r2 mm≈ | s1 mm | tolerance | s2 mm min. | t mm max. |
|---|---|---|---|---|---|---|---|---|---|---|---|---|---|---|---|---|---|---|---|
| 2R | 4 | ±0.5 | 1 | 16 | ±0.15 | 13 | 10.5 | 7 | 35 | ±0.5 | 22 | 8 | ±0.5 | 2.5 | 1.5 | 1 | ±0.04 | 0.6 | 0.7 |
| 4R | 6 | | | | | | | | 45 | | 32 | | | | | | | | |
| 6R | 10 | | 1.2 | 22 | ±0.2 | 20 | 16.5 | 12.6 | 40 | | 26 | 8.5 | | 3.5 | 2 | | | 0.7 | |
| 8R | 11.5 | | | | | | | | 45 | | 31 | | | | | | | | |
| 10R | 13.5 | ±1 | | 24 | | | | | 45 | | 30 | 9 | | 4 | | | | | |
| 15R | 19 | | | | | | | | 60 | | 45 | | | | | | | | |
| 20R | 26 | ±1.5 | 1.5 | 30 | ±0.25 | | 17.5 | | 55 | ±0.7 | 35 | 10 | ±0.75 | 5.5 | 2.5 | 1.2 | ±0.05 | | 1 |
| 25R | 32.5 | | | | | | | | 65 | | 45 | | | | | | | | |
| 30R | 37.5 | | | | | | | | 75 | | 55 | | | | | | | | |
| 50R | 62 | ±4 | 2.5 | 40 | ±0.44 | | | | 73 | ±0.75 | 49 | | | 6 | 4 | 1.5 | ±0.07 | 0.9 | 1.5 |

Figures 2A, 2B:
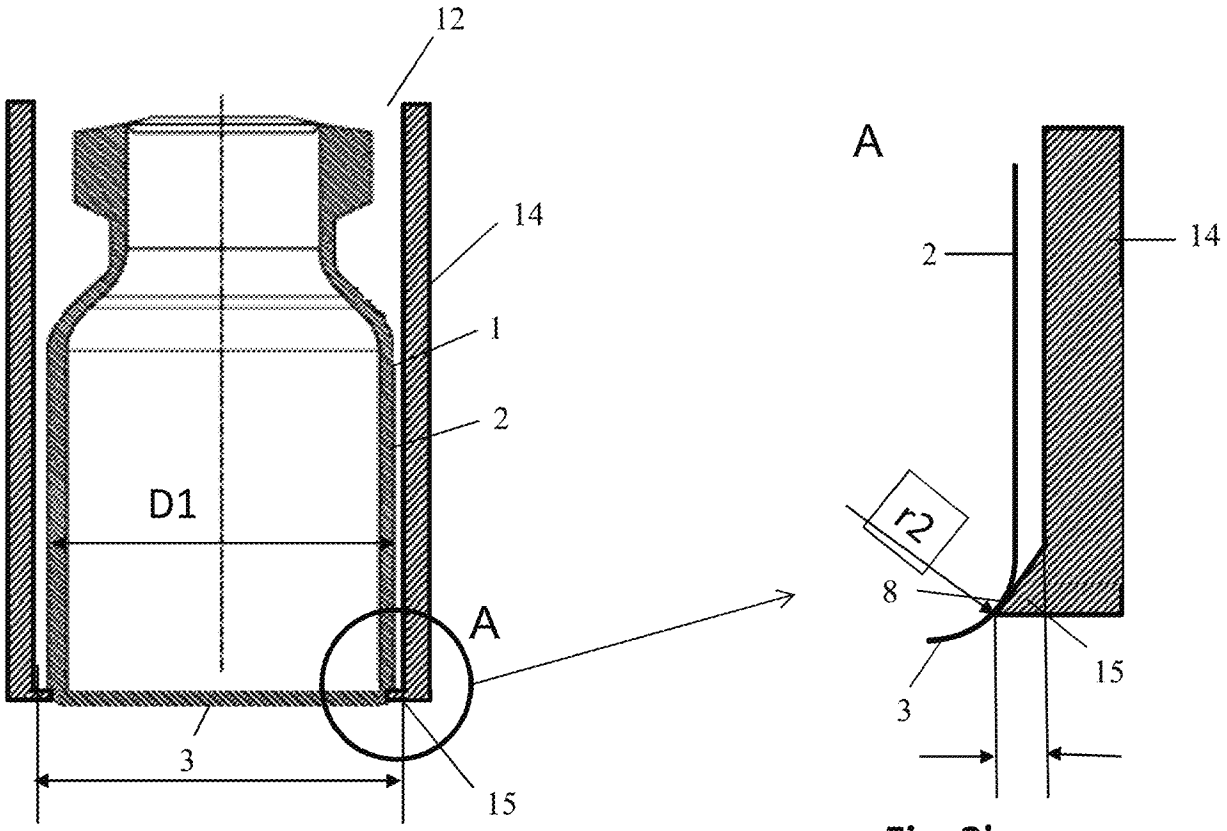
FIGS. 2*a*-2*d* show the supporting of a lower edge portion of a vial on retaining protrusions of a supporting structure according to the present invention.

The geometrical conditions at the lower ends of vials are shown on a larger scale in FIGS. 1*a* and 2*b*. It is clearly evident that a transition region is formed between the cylindrical side wall 2 extending in the axial direction and the bottom 3 extending perpendicular thereto, i.e. in the supporting position in horizontal direction. For the purposes of the present invention, this transition region 8 is considered as an edge portion, which is located outside the actual base of the vial 1, if viewed in the longitudinal direction of the vials wherein this base is defined as the contact surface of a vial 1 when resting on a flat surface. If the bottom 3 of a vial 1 is flat, as shown in FIG. 2*a*, this contact surface is circular and represents the bottom-most portion of a vial 1, if viewed in an axial longitudinal section. If the bottom of a vial 1 is concavely curved as shown in FIGS. 1*a* and 1*b*, this contact surface is annular and formed by the vertices 9 of the base 3 of the vial 1. These vertices form a ring along the edge of the base 3, if the vial 1 is viewed from below.

As can be seen in particular in FIG. 2*b*, this transition region 9 or edge portion is disposed between the bottom 3 or the base and the cylindrical side wall 2 of the vial 1 and is thus clearly separated from these two portions. While in the embodiment of FIG. 2*a* the cylindrical side wall 2 and the bottom 3, at least at the edge of the vial, is flat, the transition region or edge portion 8 is evenly curved with a uniform radius of curvature r2.

Because of the very tight tolerances that need to be fulfilled particularly at the lower ends of vials this transition region or edge portion 8 has an exactly predetermined geometry, and according to the present invention this exact geometry is used for matching the geometry of retaining protrusions 15 at the lower ends of the side walls 14 of the receptacles of the supporting structure exactly to the geometry of the transition regions or edge portions 8 of the vials. More specifically, the retaining protrusions 15 are formed such that these cooperate only with the transition regions or edge portions 8 of the vials and thus only within the aforementioned well-defined transition regions between the cylindrical side walls 2 and the bottom 3. In other words, the retaining protrusions 15 cooperate exclusively with portions of the vials outside of the respective base, but these do not cooperate with the cylindrical side wall 2.

Generally, the retaining protrusions 15 may support or hold these transition regions or edge portions by a positive-fit or by friction. However, the present invention prefers a purely positive-fit supporting of the transition regions or edge portions 8 by the retaining protrusions 15, for which purpose it is sufficient that the retaining protrusions 15 protrude in radial direction sufficiently far into the apertures or receptacles of the supporting structure for preventing that the vials slip through downward. Surprisingly, an evaluation of the typical geometry at the lower ends of vials but also of other pharmaceutical containers, such as cartridges, has revealed that it is possible to form retaining protrusions 15 of a suitable material with sufficiently tight tolerances, so that such a supporting can be ensured in a reliable manner.

As shown in FIG. 2*b*, retaining protrusions 15 provided at the lower ends of the apertures or receptacles of the supporting structure protrude inward in radial direction into the apertures or receptacles for supporting the vials in cooperation with the transition regions or edge portions 8 of the vials in such a manner that bottoms of the vials, or more generally the lower ends of the vials, jut out of the apertures or receptacles and are thus are freely accessible from the lower side of the carrier. This support is shown overall in FIG. 2*a*. Shown is a generally tubular receptacle 12 formed by a circumferential side wall 14 of the supporting structure (not shown). The side wall 14 may extend vertically downward (as shown schematically in FIG. 2*a*), but may also be inclined uniformly by a relatively small angle relative to a central perpendicular line to extend inward in radially radial direction. This angle may, for example, be in the range between about 1 degree and about 3 degrees, more preferably between about 1 degree and about 2 degrees, in particular for enabling a deforming of the supporting structure from a mold used for manufacturing the same using an injection molding process. At the lower edge of the side wall 14, a retaining protrusion 15 is formed, as shown on a larger scale in FIG. 2*b*. Is clearly visible that the bottom 3 of the vial 1 protrudes beyond the lower edge of the side wall 14, wherein, however, the transition region or edge portion 8 of the vial is supported sufficiently in order to support the total weight of the vial 1, including the content and a closure (each not shown) and to prevent slippage of the vials 1 out of the receptacle 12. In FIG. 2*a*, it is also clearly visible that for the supporting according to the present invention a gap is formed between the inner surface of the side wall 14 and the outer surface of the cylindrical side wall 2 of the vial 1, which enables a friction-free insertion of the vial 1 into the receptacle 12 from above and an axial displacement of the vial 1 inside the receptacle 12 with very low forces.

Figure 2C:
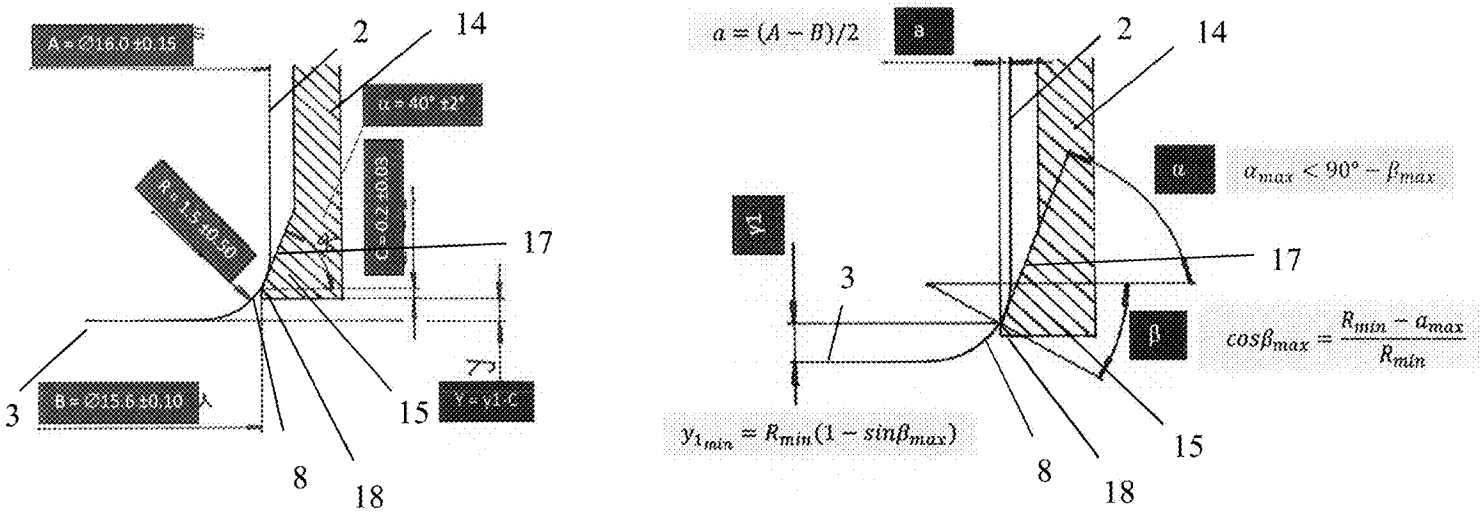

The geometric relationships of the supporting of the transition region or edge portion 8 on the at least one retaining protrusion are shown in FIG. 2*c* on a larger scale for an embodiment of a vial having a planar bottom 3. This drawing also shows the tolerances and dimensions in millimeters for 2R-vials to 4R-vials and mathematical formulas for the dependency of important values of tolerances and geometric parameters are indicated.

Corresponding considerations of the tolerances can be made for vials of other sizes, as summarized in the following Table 2:

TABLE 2 results of considerations of tolerances for vial of different sizes

| | convexity (dimensions in mm) | | | | | | | | | | |
|---|---|---|---|---|---|---|---|---|---|---|---|
| | tray | | | | vial | | | | | | |
| | nominal inner diameter of | | maximum diameter | minimum diameter | nominal dimension of vial | | | | consideration of tolerances | | |
| product | nest at convexity | tolerances | of nest at collar | of nest at collar | diameter D1 | tolerances | maximum diameter | minimum diameter | maximum fit | minimum fit | radius r2 |
| 2/4R | 16.5 | +/−0.1 | 13.6 | 13.4 | 16 | +0.15/−0.15 | 13.15 | 12.85 | +0.75 | +0.25 | 1.5 |
| 6/8/10/15R | 22.5 | +/−0.1 | 22.6 | 22.4 | 22 | +0.2/−0.2 | 22.2 | 21.8 | +0.8 | +0.2 | 2 |
| 10/15R | 24.5 | +/−0.1 | 24.6 | 24.4 | 24 | +0.2/−0.2 | 24.2 | 23.8 | +0.8 | +0.2 | 2 |
| 20R | 30.5 | +/−0.1 | 30.6 | 30.4 | 30 | +0.25/−0.25 | 30.25 | 29.75 | +0.85 | +0.15 | 2.5 |
| 30R | 30.5 | +/−0.1 | 30.6 | 30.4 | 30 | +0.25/−0.25 | 30.25 | 29.75 | +0.85 | +0.15 | 2.5 |

Considerations of tolerances were made for containers of different sizes. The result of such considerations is that the distance by which the retaining protrusions protrude into the apertures or receptacles in radial direction should amount to at least >50% of the r2-value (radius of curvature). The retaining protrusions should be tapered towards their free end (which is of advantage but is not absolutely necessary). The material thickness at the front ends of the retaining protrusions should amount to <50% of the r2-value.

Considering the different geometries of 2R-vials to 30R-vials, it is observed that the bottom radius r2 typically varies from r2=1.5 mm to r2=2.5 mm. Thus, the bottom radius r2 is about 10 times as large as the variation of the outer diameter (0.15 mm to 0.25 mm). A supporting and centering at the bottom radius is thus a technical feature because the tolerances of the outer diameter of the container are much smaller than the contact surface at the bottom edge. The maximum fit in Table 2 is equal to or less than 50% of the bottom radius r2.

The supporting structure can be produced with a sufficient accuracy and in a cost-efficient manner by injection molding, by a deep drawing process or by 3D printing. However, the carrier may also be formed from a fiber-reinforced plastic or a plastic material, to which ceramics or metals are added to increase its thermal conductivity. It is known that fiber-reinforced plastics have a higher thermal conductivity of up to 0.9 W/(m*K) if carbon fibers are added. If ceramics or metals are added to the plastics, the thermal conductivity becomes even larger, resulting in so-called heat-conducting plastic materials. Thus, a thermal conductivity of the material of the supporting structure of up to 20 W/(m*K) may be accomplished.

Figure 3B:
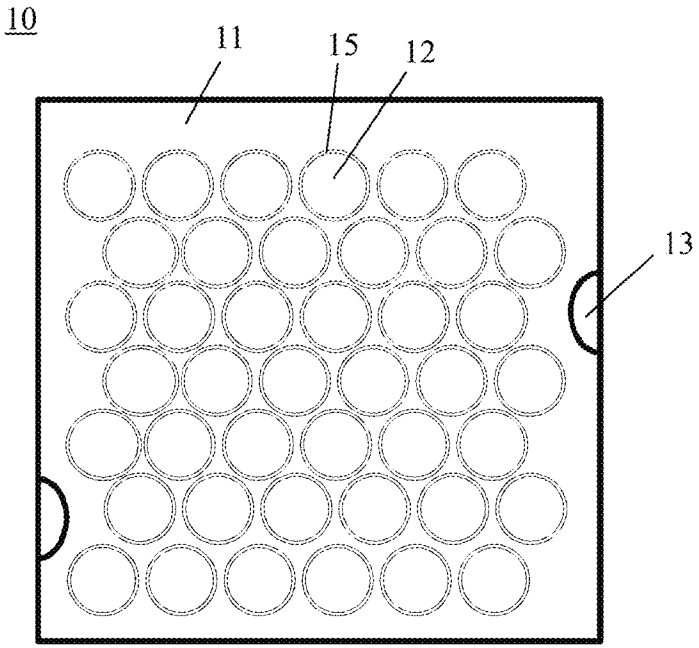
FIGS. 3*a*-3*b* are two examples of a supporting structure according to the present invention in a plan view.
Figure 3A:
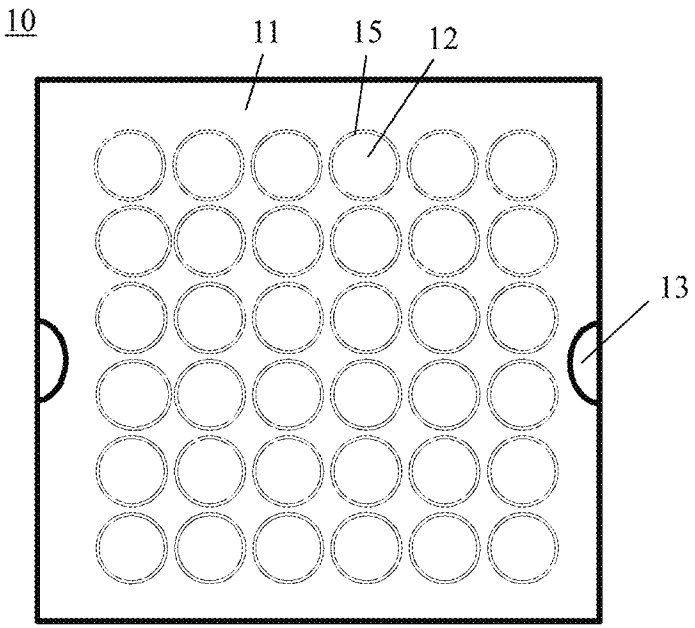

FIGS. 3*a*-3*b* show two examples of a supporting structure 10 according to the present invention in a plan view. The individual apertures or receptacles 12 in the carrier 11 are preferably arranged in a regular array, for example in a matrix arrangement along rows and columns extending perpendicular thereto (FIG. 3*a*) or along rows intersecting each other at an acute angle (FIG. 3*b*). This has advantages in the automated processing of the vials, since the vials can be transferred at controlled positions and in a predetermined arrangement to processing stations, for example to processing machines, robots or the like. The separation between the apertures or receptacles may also be implemented by means of individual webs.

Figure 3E:
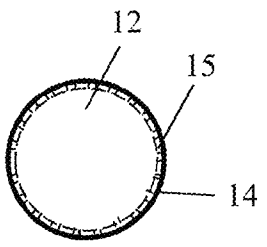
FIGS. 3*c*-3*e* show three examples of the shape of retaining protrusions of a supporting structure according to the present invention in a plan view.
Figure 3D:
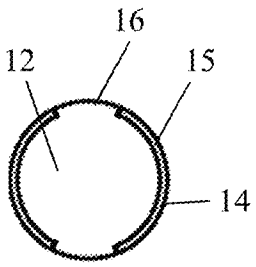
Figure 3C:
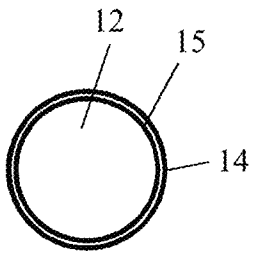

FIGS. 3*c*-3*e* show three examples for the shape of retaining protrusions 15 of a supporting structure according to the present invention in a plan view. According to FIG. 3*c*, a single retaining protrusion is formed as a circumferential, radial projection 15 at the lower edge of side wall 14. According to FIG. 3*d* two retaining protrusions 15 are arranged at equiangular distances to each other and with gaps 16 between them along the bottom of side wall 14. According to FIG. 3*e*, a plurality of retaining protrusions 15 are arranged at equiangular distances to each other and with gaps 16 formed therebetween along the lower edge of side wall 14, which enables a certain flexibility of the retaining protrusions 15 in a simple manner.

By selection of the material and thickness of the retaining protrusions 15, these can be set to be sufficiently stable for supporting the vials reliably at their edge portions while preventing a slipping through of the vials in a reliable manner. However, the specific shape of the retaining protrusions 15 also has an effect on the supporting force of the retaining protrusions that can be accomplished.

Generally, the surface 17 of the retaining protrusions 15 facing the transition region or edge portion 8 may be inclined toward the bottom of the carrier at a predetermined angle relative to a line perpendicular to a plane spanned by the carrier, as shown in FIG. 2*c*, wherein the angle is specifically matched to the geometry of the container to be supported at its lower end, but is usually about 45 degrees, and conveniently lies in a range between 10 degree and 70 degrees, more preferably in the range between 20 degrees and 50 degrees.

Generally, the surface 17 of the retaining protrusions 15 facing the transition region or edge portion 8, however, may also be curved, particularly concavely curved, with a radius of curvature r2 which basically corresponds to the afore-mentioned bottom radius r2 of the vial to be supported.

Figure 2D:
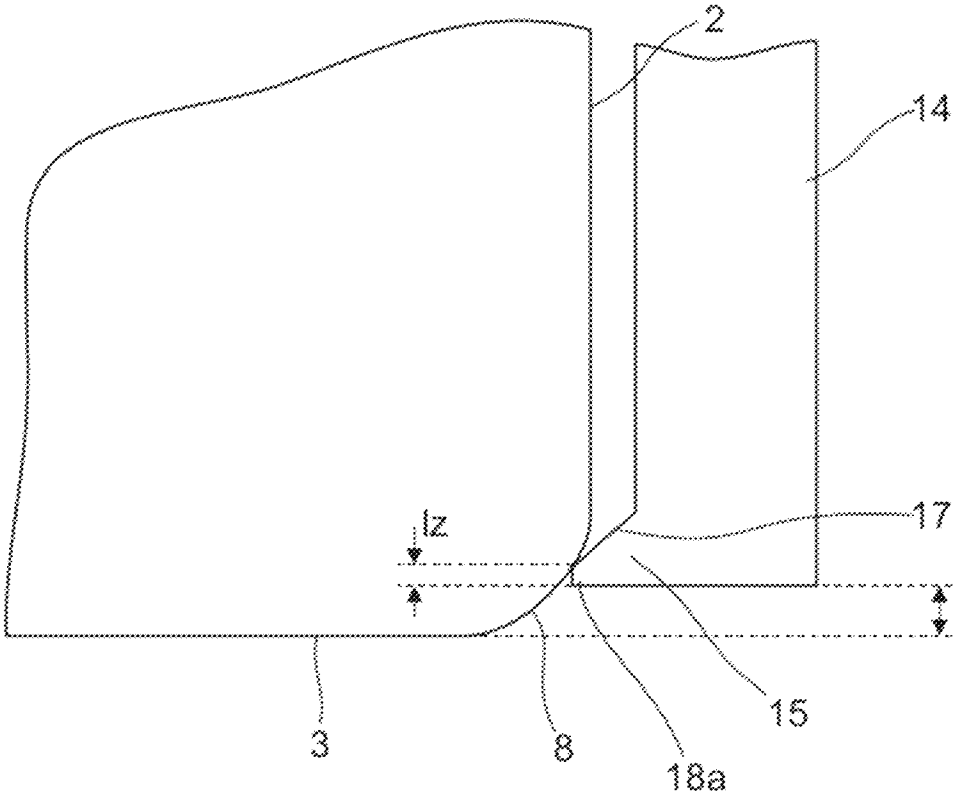

As shown in FIG. 2*d*, for further reinforcing the retaining protrusions 15 additional straight portions 18*a* may be formed at the front ends of the retaining protrusions 15 extending perpendicular to a plane spanned by the carrier, i.e. in the longitudinal direction of the vial to be supported, wherein the axial length of the straight portions 18*a* in a direction perpendicular to the plane spanned by the carrier then essentially determines the bending rigidity of the retaining protrusions 15. Conveniently, this axial length may be in the range of 0.1 to 5.0 mm, preferably in the range of 0.1 to 2.0 mm.

Figure 4A:
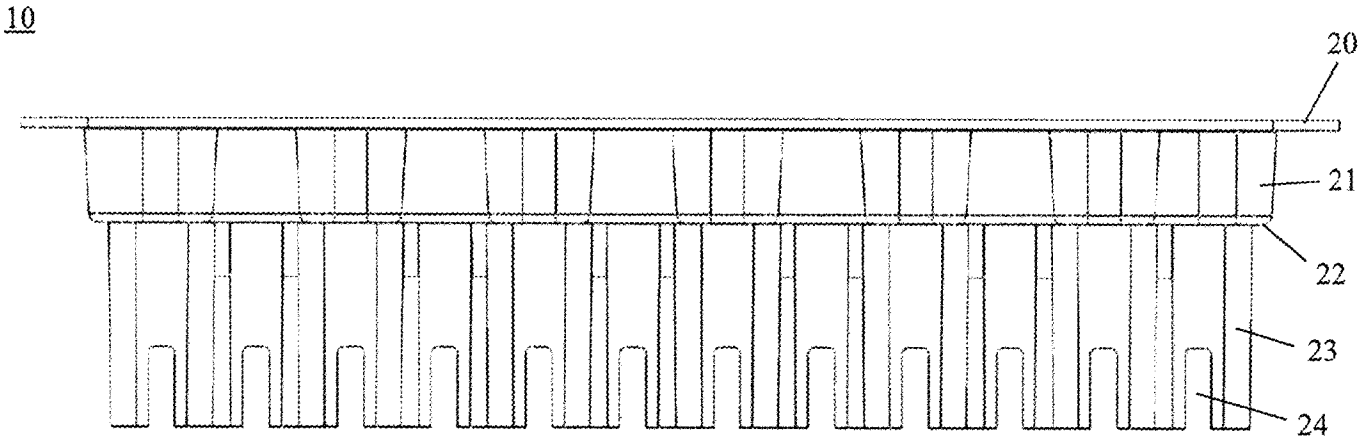
FIG. 4*a* shows a supporting structure according to a first embodiment of the present invention in a side view.

FIG. 4*a* shows a supporting structure 10 according to a first embodiment of the present invention in a side view. This supporting structure 10 is generally formed as nest having a plurality of tubular receptacles for accommodating the vials, preferably for accommodating the vials completely or over their entire length, and comprises an upper supporting flange 20, which is followed by the upper side wall 21 with a horizontal step 22 at its lower edge. The tubular receptacles for accommodating the vials extend vertically downward from this step 22. The space formed by the upper side wall 21 may be trough-shaped. When the upper ends of vials accommodated in the receptacles project into this space, the upper ends can be gripped in a simple manner, for example, by robots or gripping devices so that the vials can be removed from the receptacles toward the upper end or so that the vials can be inserted into the receptacles from above.

As shown in FIG. 4*a*, slots 24 may be formed at the lower ends of the side walls 23 which are aligned with each other in predetermined directions, e.g. along a direction perpendicular to the longitudinal side of the supporting structure 10, as shown in FIG. 4*a*. In this manner, e.g. strip-shaped height adjusting devices may engage into the slots 24, which are disposed below the bottoms of the vials and in alignment with these slots 24 for lifting or lowering the vials suitably by adjusting the height. Or the slots 24 permit a flexing of the supporting structure 10, and thereby an expansion of the lower ends of the receptacles whereby the vials may be brought 'out of engagement' downward.

Figure 4B:
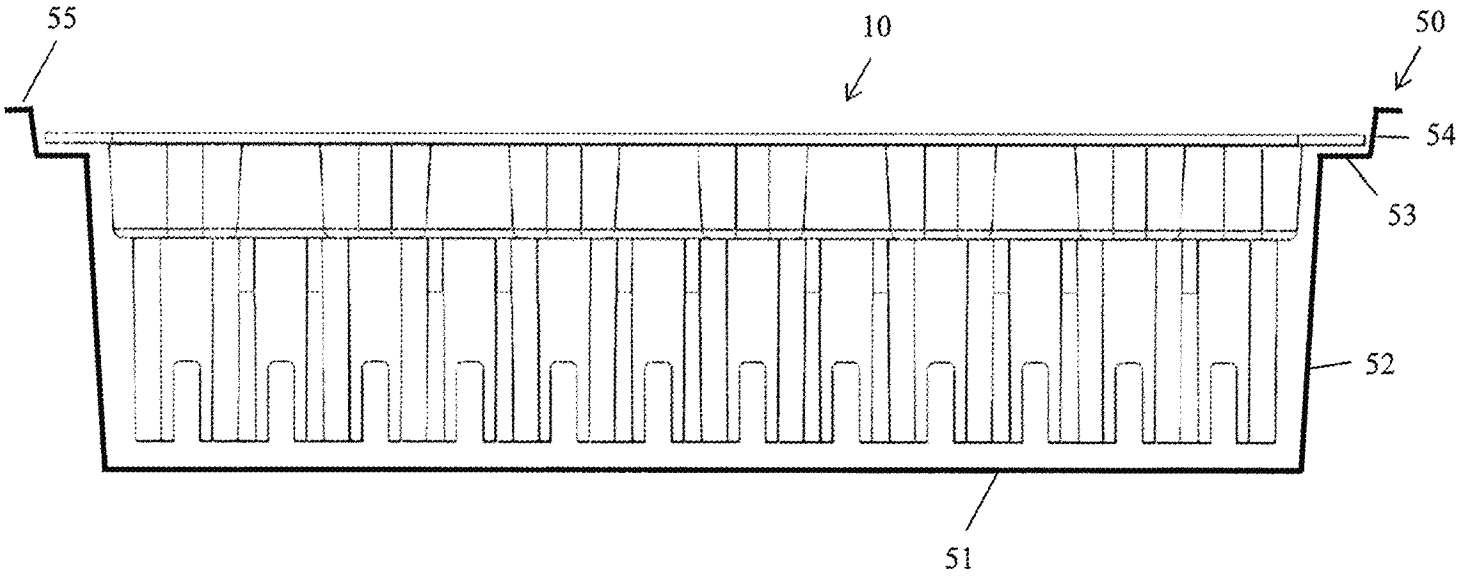
FIG. 4*b* shows the supporting structure of FIG. 4*a*, which is accommodated in a transport and packaging container.

FIG. 4*b* shows the accommodation of such a supporting structure 10 in a trough-shaped transport and packaging container 50 (also named as so-called tub hereinafter). The transport and packaging container 50 comprises a closed bottom 51, a circumferential side wall 52 extending substantially perpendicular to bottom 51, which is followed by horizontal step 53 on which the upper supporting flange 20 of the supporting structure 10 is supported, an upper side wall 54, which is inclined relative to a line perpendicular to the bottom 51, and a flange 55 at the upper rim. The transport and packaging container 50 may be sealed by means of a protective film or a packaging film bonded on the upper rim 55. The protective film may be, in particular a gas-permeable plastic film, in particular a web of synthetic fibers such as polypropylene fibers (PP), or a Tyvek® protective film, which enables the sterilization of the vials accommodated and packaged in the supporting structure 10 via the film.

Figure 5:
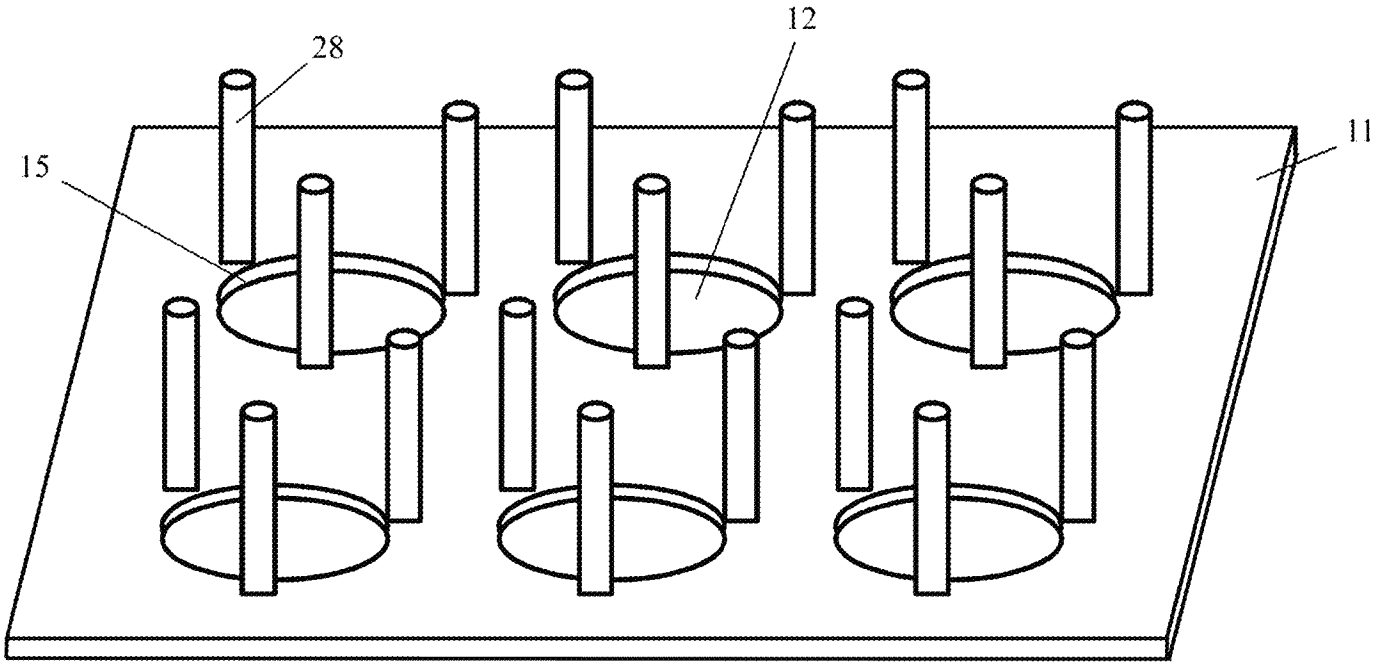
FIG. 5 shows a supporting structure according to a second embodiment of the present invention in a perspective top view.

FIG. 5 shows a supporting structure 10 according to a second embodiment of the present invention in a perspective top view. This is formed as a flat supporting plate 11 of a relatively small thickness, preferably made of a plastic material, as described above. The apertures in the supporting plate 11 are formed as through holes 12, at the lower ends of which the retaining protrusions 15 are formed in the afore-mentioned manner, preferably integrally with the supporting structure 11 for sufficiently supporting the vials. If a lateral (radial) guidance is desired, and in particular if a collision of vials, which are supported in directly adjacent apertures 12, is to be prevented, guiding members 28 in the form of pins, plates or the like may be provided on the upper side of the supporting plate 11 at least in sections along edges of the apertures 12, which guiding members extend perpendicular to the upper side of the supporting plate 11.

FIGS. 6*a*-6*d* show examples of the use of a supporting structure according to the present invention in a freeze-drying process, in each case in a schematic side view.

Figure 6A:
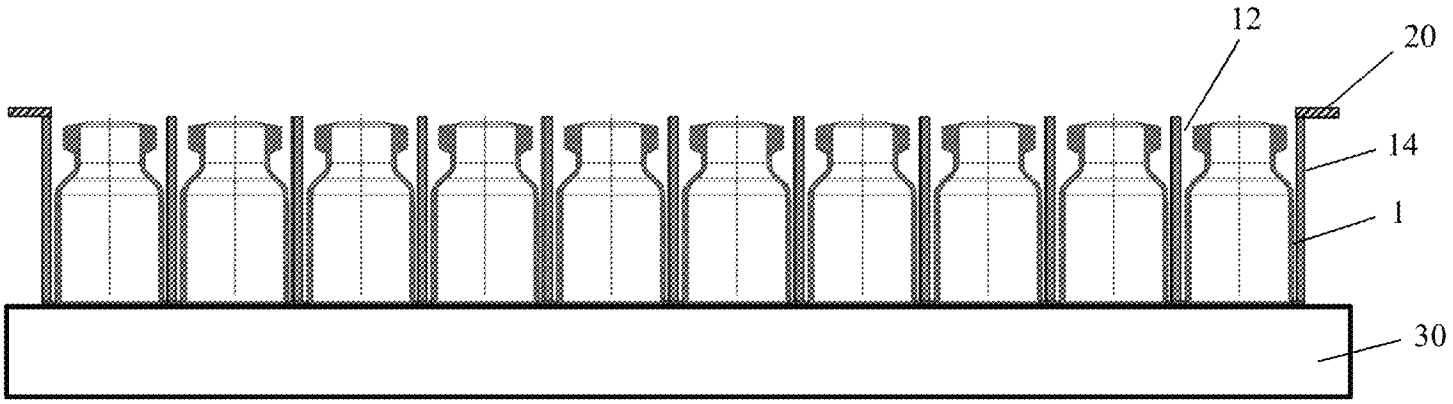
FIGS. 6*a*-6*d* are examples for the use of a supporting structure according to the present invention in freeze-drying, in each case in a schematic side view.

According to FIG. 6*a*, the cooling surface 30 is planar. The bottoms of the vials 1 are in direct contact with the upper side of the cooling surface 30. Conveniently, the supporting structure 20 rests on the upper side of the cooling surface 30 so that the vials 1 rest freely on the cooling surface 30. Of course, the supporting structure 20 may also be lifted relative to the cooling surface 30 by a small distance as long as the direct contact of the bottoms of the vials 1 with the upper side of the cooling surface 30 is ensured.

Figure 6B:
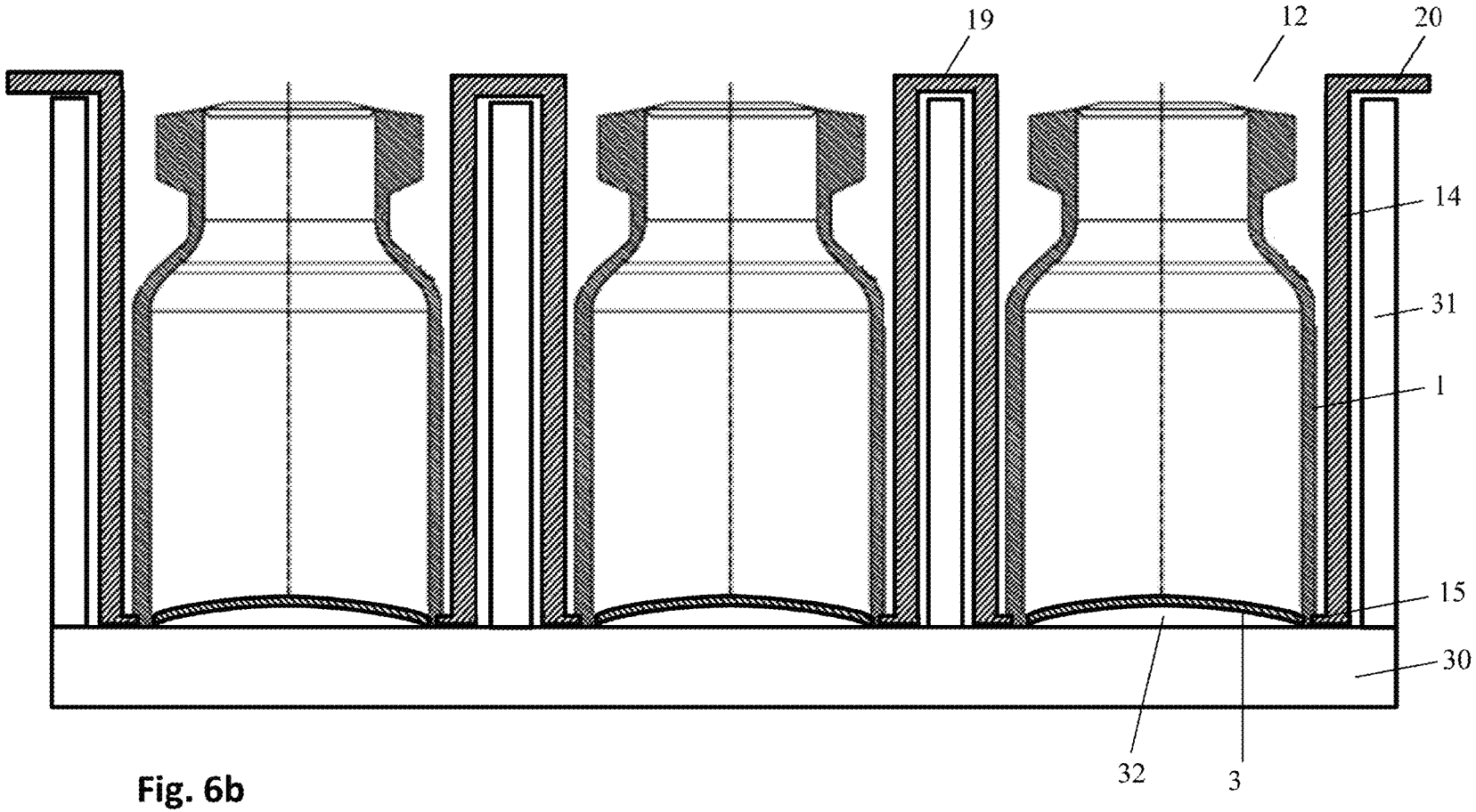

According to FIG. 6*b*, the bottoms 3 of the vials 1 are concavely curved at their centers so that an annular convex gap is formed between the upper side of the cooling surface 30 and the bottoms 3, which may have a beneficial effect on a freeze-drying process. Furthermore, gaps are formed between the side walls 14 of directly adjacent receptacles 12 of the supporting structure into which the cooling fingers 31 project, which surround the receptacles 12 of the supporting structure at least in sections and preferably completely (as circumferential cooling fingers). This may provide an even faster and more effective cooling in a freeze-drying process.

Figure 6C:
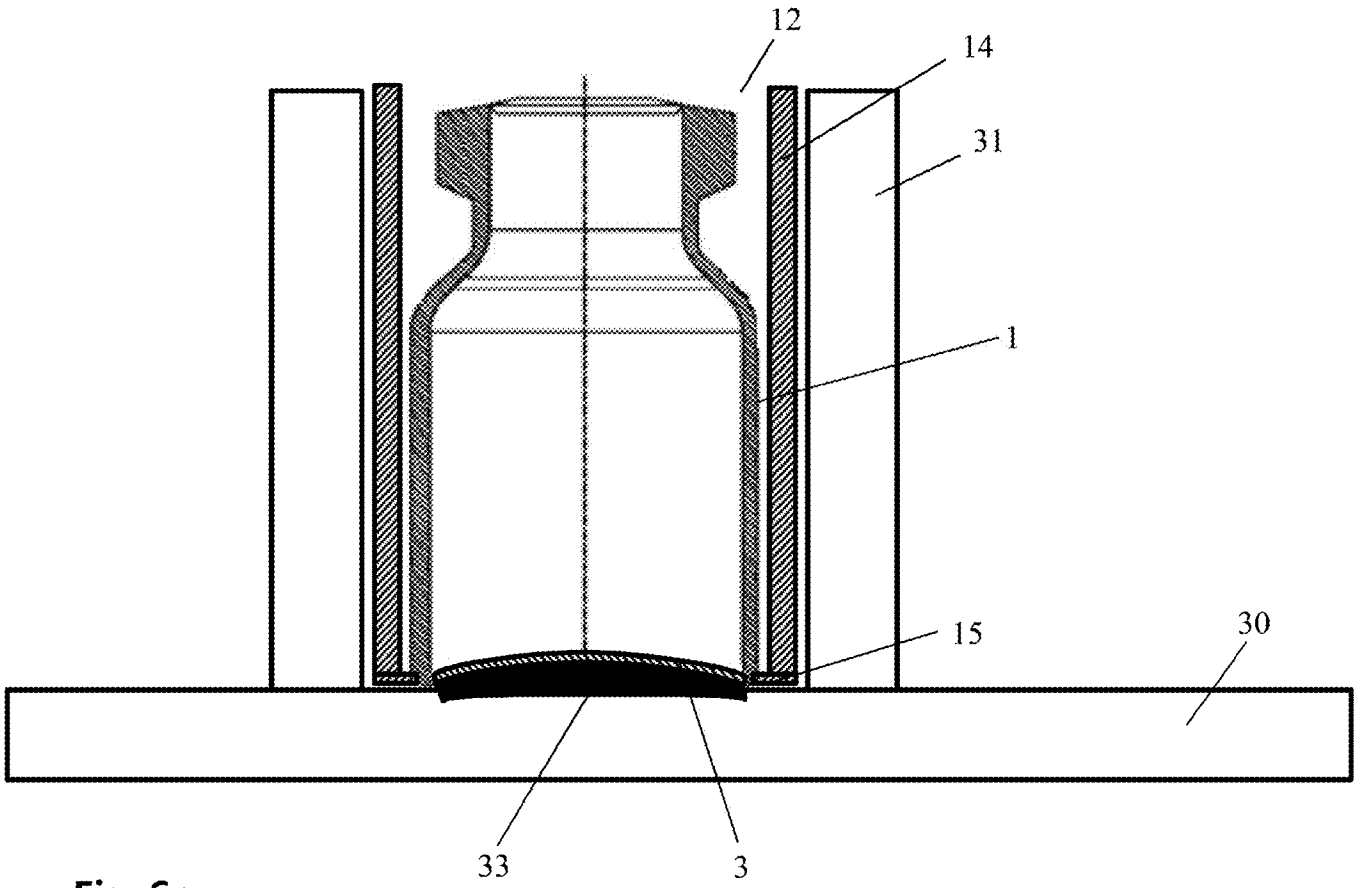

According to FIG. 6*c*, the bottoms 3 of the vials 1 are concavely curved at their centers, wherein convex projections 33 are formed on the upper side of the cooling surface having a radius of curvature which is matched to the radius of curvature of the bottom 3 in order to ensure a direct contact between the bottom 3 and the upper side of the cooling surface 30.

Figure 6D:
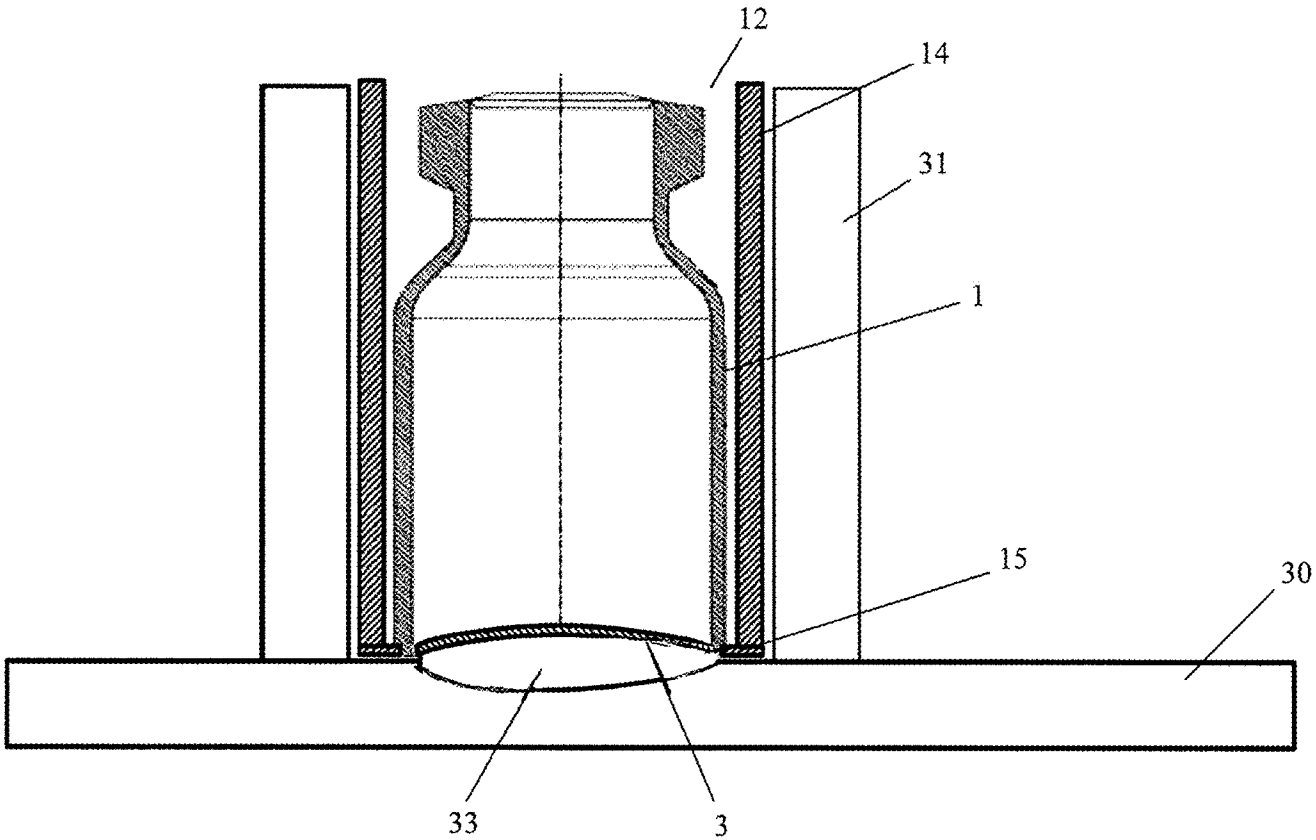

According to FIG. 6*d*, the bottoms 3 of the vials 1 are concavely curved at their centers, wherein concave depressions 34 are formed on the upper side of the cooling surface for reducing the thermal contact in this region, which may have a beneficial effect on a freeze-drying process.

Figure 7A:
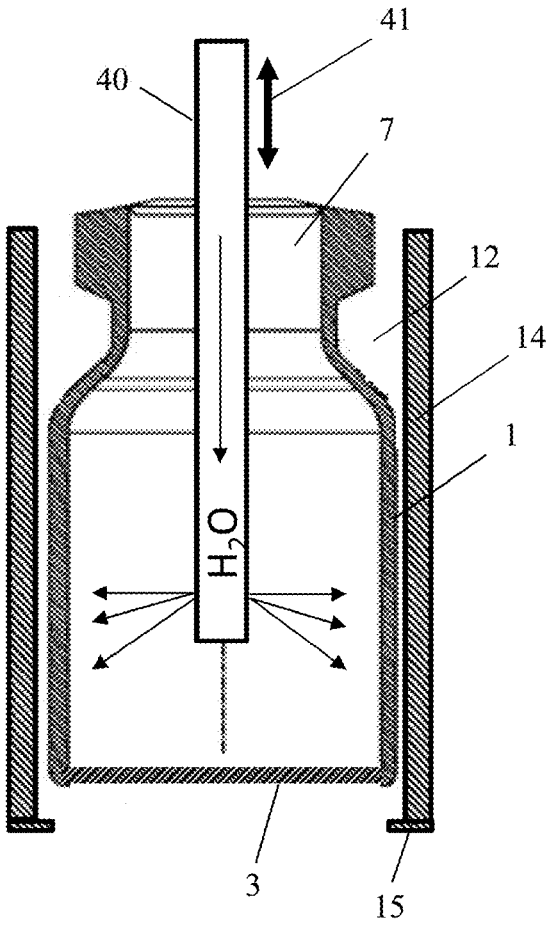
FIG. 7*a* shows an example for the use of a supporting structure according to the present invention for a cleaning of the inner surfaces of the vials.

FIG. 7*a* shows an example of the use of a supporting structure according to the present invention for the internal cleaning of a vial 1, which is accommodated in a receptacle 12 of the supporting structure (not shown). For this purpose, a nozzle or pipe 40 is inserted by means of a height adjustment device 41 via the filling opening 7 into the interior of the vial 1 to spray a cleaning liquid (in this case water) into the vial 1. After this cleaning step the vial 1 is dried and then filled with a substance or liquid.

Figure 7B:
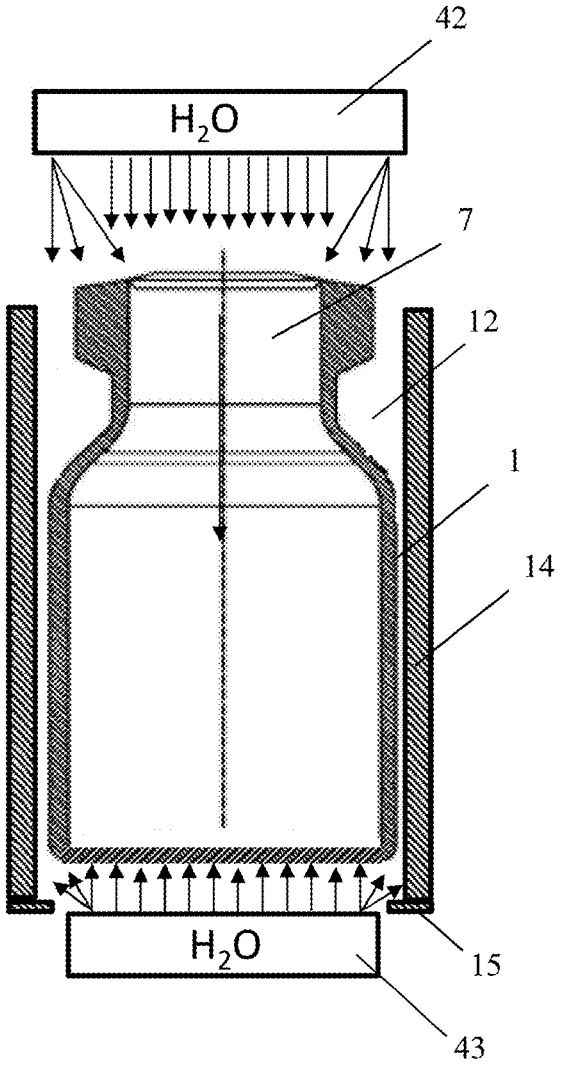
FIG. 7*b* shows an example of the use of a supporting structure according to the present invention for a cleaning of the outer surfaces of the vials.

FIG. 7*b* shows as a further example of the use of a supporting structure according to the present invention the cleaning of the outer surfaces of a vial 1, which is accommodated in the receptacle 12 and supported on the retaining protrusions 15. By means of a lower spraying device 43, a cleaning fluid, preferably a cleaning liquid, such as water or a water steam, is sprayed from below against the bottom of vial 1. If this is performed with a sufficient intensity the vial 1 can be lifted off the retaining protrusions 15, so that the vial 1 floats freely in the receptacle 12 ('levitation'). Thereby a flow is formed temporarily in an annular gap between the outer wall of vial 1 and the inner surface of side wall 14, which flows over the outer surface of the vial 1 and cleans it. The flow exits again at the upper end of the receptacle 12. If the intrusion of the cleaning liquid into the interior of the vials is to be prevented 1, the filling aperture 7 of the vial 1 will be closed beforehand, for example by means of a plug. Alternatively or at the same time, a cleaning fluid, preferably a cleaning liquid, such as water or a water steam, may also be sprayed from the top into the receptacle 12 by means of an upper spraying device 42. In the case of a simultaneous spraying both from below and from above, the fluid flow from the lower end should in any case be more intense than the fluid flow from the top to a sufficient extent, preferably such that the bottom of the vial 1 is lifted off the retaining protrusions 15 so that the vial 1 floats freely in the receptacle 12 (levitation').

Figure 7C:
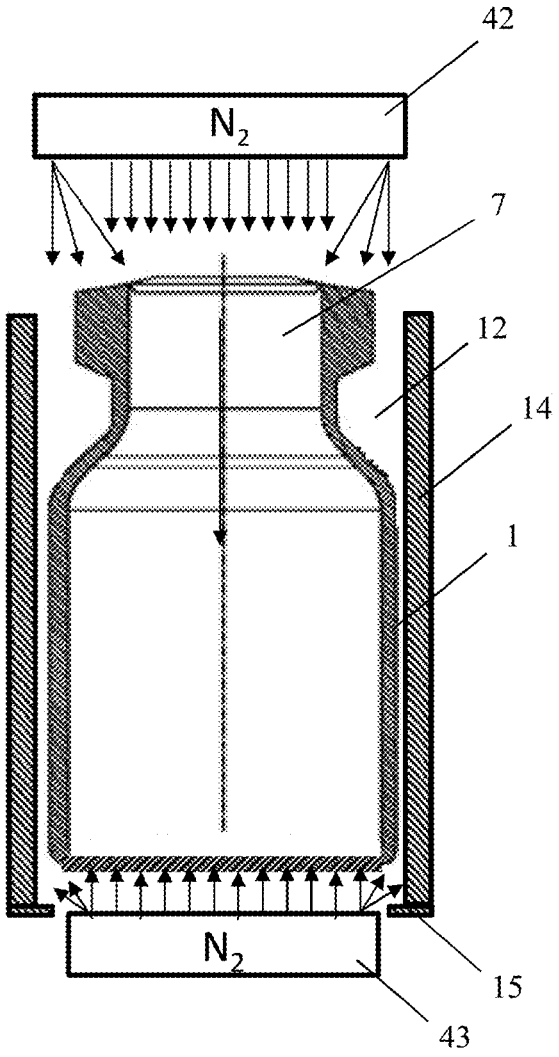
FIG. 7*c* shows an example of the use of a supporting structure according to the present invention during lifting and lowering the vials in receptacles of the supporting structure and during the drying of the outer surfaces of the vials.

FIG. 7*c* shows a further example of the use of a supporting structure according to the present invention during lifting and lowering of the vials in receptacles of the supporting structure, and for drying the outer surfaces of the containers.

By means of a lower spraying device 43, a gas, for example nitrogen, is blown against the bottom of the vial 1 from the lower end. If this is performed with a sufficient strength the vial 1 can be lifted from the retaining protrusions 15 so that the vial 1 floats freely in the receptacle 12 ('levitation'). Thereby a gas flow is formed temporarily in the annular gap between the outer wall of the vial 1 and the inner surface of the side wall 14, which flows over the outer surface of the vial 1 and thus dries it. The gas flow exits again at the upper end of the receptacle 12. If the intrusion of the gas into the interior of the vial 1 shall be prevented, the filling opening 7 of the vial 1 will be closed beforehand, for example by means of a plug. Alternatively or at the same time a gas, for example nitrogen may also be blown into the receptacle 12 from above by means of an upper spraying device 42. In the case of simultaneous injection of gas both from below and from above, the gas flow from the bottom should in any case be more intense than the gas flow from the upper end to a sufficient extent, preferably such that the bottom of the vial 1 is lifted from the retaining protrusions 15 so that the vial 1 floats freely in the receptacle 12 (levitation') and so that all portions on the outer surface of the vial 1 can be dried.

Figure 7D:
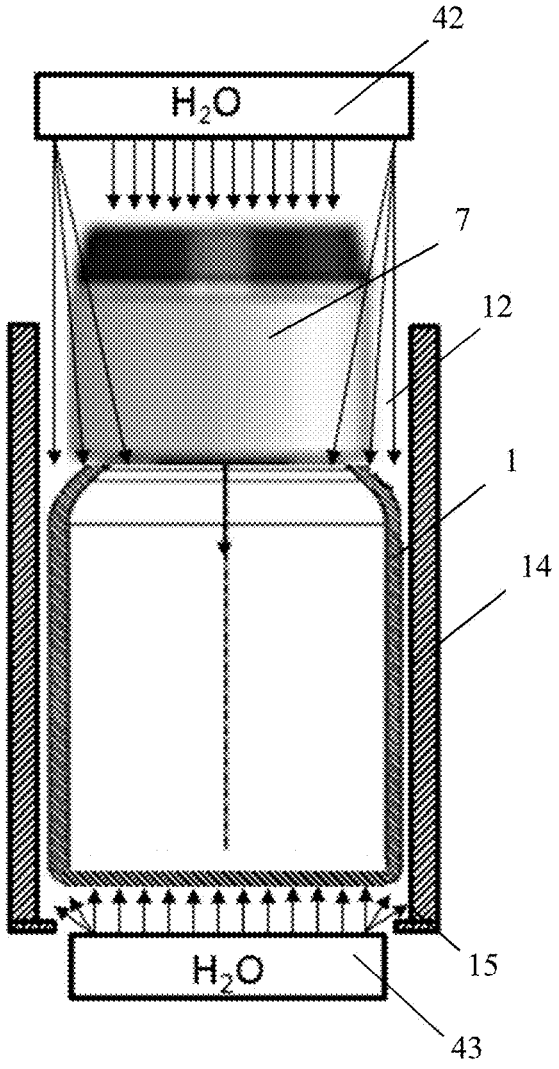
FIG. 7*d* is an example of the use of a supporting structure according to the present invention for cleaning of the outer sides of the vials, which is sealed by means of a press-fit closure cap.
Figure 7E:
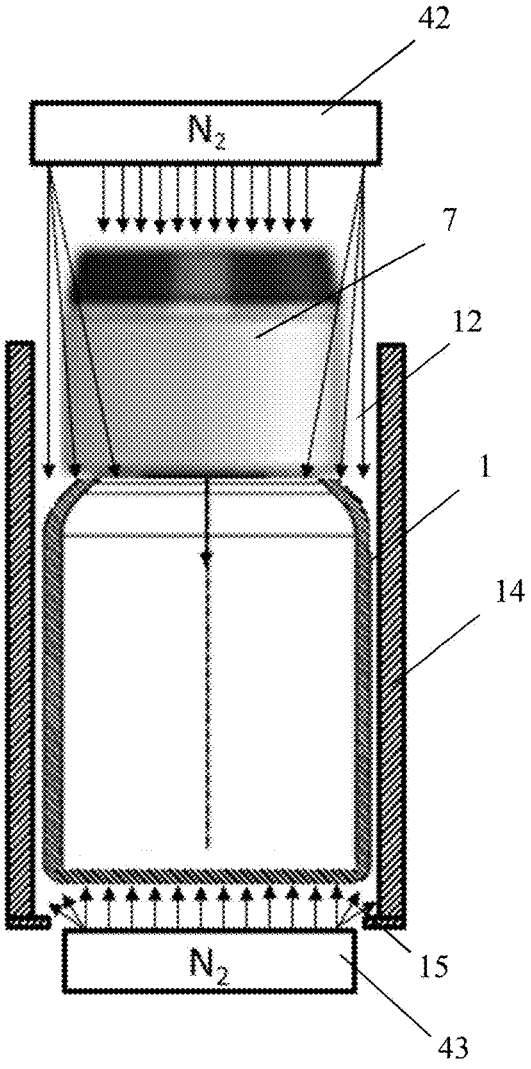
FIG. 7*e* is an example of the use of a supporting structure according to the present invention during lifting and lowering the vials in receptacles of the supporting structure and the drying of the outer surfaces of the vials, which are sealed by means of a press-fit closure cap.

FIGS. 7*d* and 7*e* show the treatment of vials according to FIGS. 7*b* and 7*c*, wherein so-called press-fit caps are placed on the upper ends of the containers 1, which cover the filling openings but continue to ensure that the interior of the vial 1 is in communication with the gas environment in a first position so that moisture and vapors may exit via the cap into the environment during a freeze-drying process. Only if the caps are pressed completely downward into a second position, this communication no longer exists so that the interior of the vial is then sealed gas-tight against the environment. The caps are thus pressed completely downward after the actual freeze-drying process. During the freeze-drying process the caps are in the first position.

Figure 8:
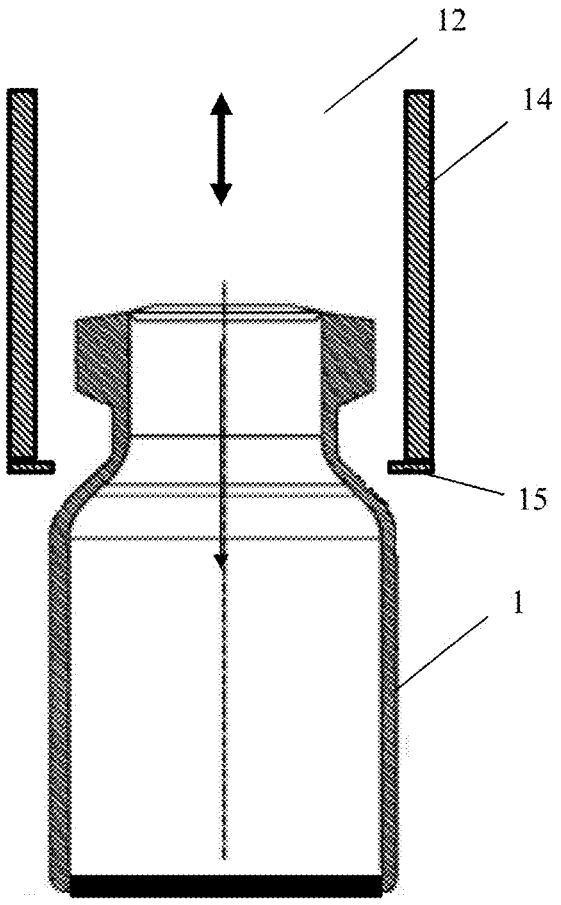
FIG. 8 is another example of the use of a supporting structure according to the present invention for the removal of the vials out of receptacles of the supporting structure via the lower ends of the receptacles.

According to FIG. 8, the injection of a gas or fluid from above into the receptacles 12 may also be used in order to push the vials 1 downward and out of the receptacles 12, wherein the supporting force exerted by the retaining protrusions 15 must be overruled. To mitigate this supporting force, the carrier of the supporting structure may be bent suitably to expand the lower ends of the receptacles 12 appropriately. This expansion may be performed to such a degree that the aperture widths of the retaining protrusions 15 is larger than a maximum outer dimension of the vials 1 so that the vials 1 can also be removed out of the receptacles 12 downward without any friction. In this case, slots 24 at the lower ends of the receptacles 12 may enhance the bending of the supporting structure (see FIG. 4*a*), as stated above.

Figure 9:
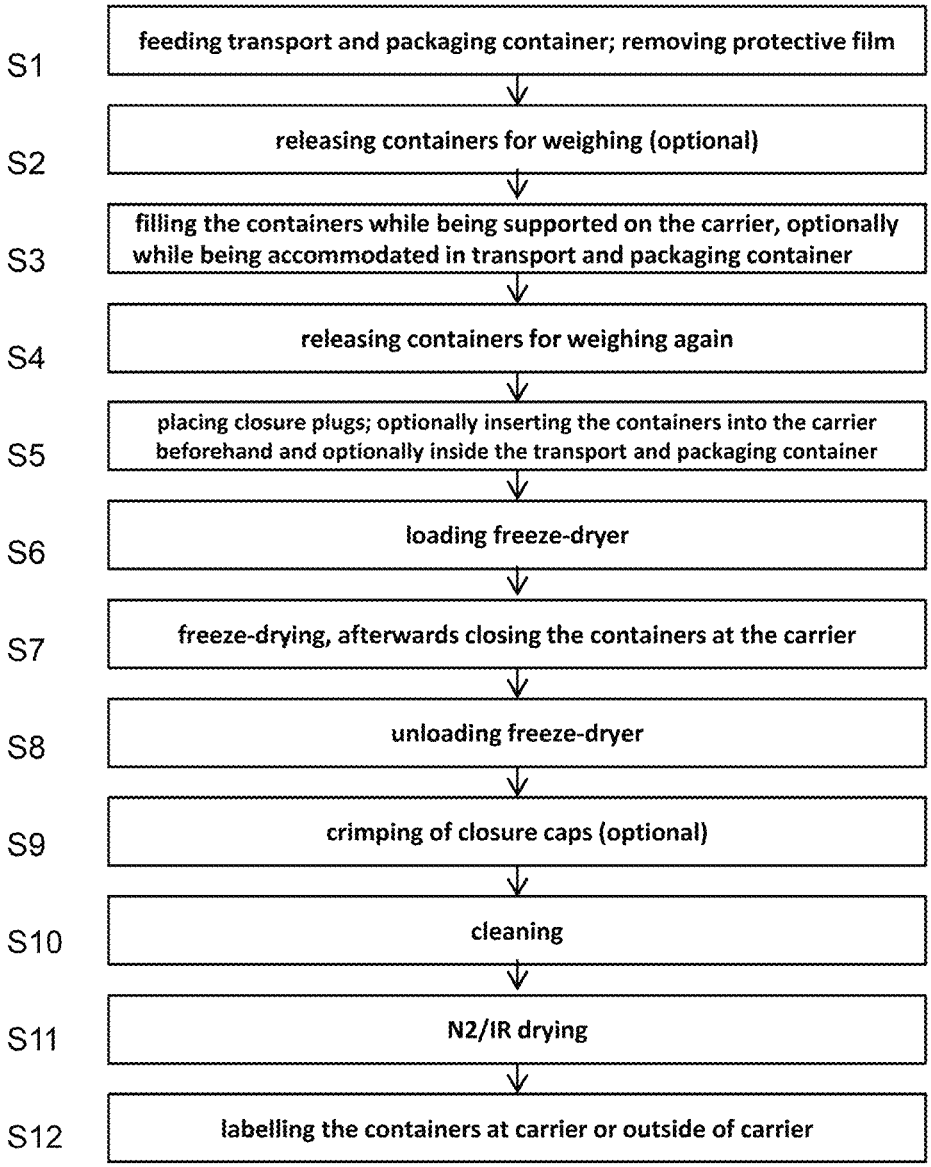
FIG. 9 is a schematic flow diagram of a method according to the present invention for the treatment of vials for substances for pharmaceutical or medical applications.

FIG. 9 shows a schematic flow diagram of a method according to the present invention for the treatment of vials for substances for pharmaceutical or medical applications.

In step S1, a transport and packaging container (cf. FIG. 4*b*) is fed and then introduced into a sterile processing environment, and then a protective film is peeled off from the upper rim thereof. In step S2, the vials are then released. Before the vials are filled with a substance or liquid, the vials may be weighed (optional step). Subsequently, in step S3, the vials are filled while they are supported on the supporting structure. The supporting structure may still be accommodated in the transport and packaging container, as shown in FIG. 4*b*. In step S4, the vials are then released again. After the filing of the containers with a substance or fluid, they can be weighed again (optional step).

In step S5, plugs or special stoppers (e.g. press-fit caps) are inserted into the filling openings of the vials for sealing. If a freeze-drying process shall be performed afterwards, press-fit caps will be inserted into the filling openings, which cover the filling openings for preventing the intrusion of contaminants but ensure at the same time that the inner volumes of the vials are still in communication with the environment via the press-fit caps. Such caps are shown in FIGS. 7*d* and 7*e*.

Optionally, the vials may also be inserted into the receptacles or apertures of the supporting structure at this time to be further treated while being supported at the supporting structure.

In step S6, the supporting structure together with the vials supported at it is placed in a freeze-dryer. Subsequently, in step S7, a freeze-drying process is performed, which is, however, not mandatory. In any case, the vials are sealed against the environment in a gas-tight manner by pressing the press-fit caps downward after the freeze-drying (lyophilization) step S7.

The supporting structure is then removed again from the freeze-drier in step S8. Here, the vials remain to be accommodated in the receptacles of the supporting structure.

In step S9, metal caps are crimped onto the upper ends of the vials with the closure plugs or caps (optional step). Here, the vials remain to be accommodated in the receptacles of the supporting structure.

In step S10, a cleaning of the outer surfaces of the vials is performed. Here, the vials remain to be accommodated in the receptacles of the supporting structure. The cleaning step is carried out as described above with reference to FIG. 7*b*.

In step S11, a drying the outer surfaces of the vials is performed. Here, the vials remain to be accommodated in the receptacles of the supporting structure. The drying step is carried out as described above with reference to FIG. 7*c*, or alternatively by applying heat, in particular by application of infrared radiation.

Afterwards, the vials may be labeled or marked in step S12. Here, the vials remain to be accommodated in the receptacles of the supporting structure. Or the vials are removed from the receptacles of the supporting structure beforehand, as described above, in particular with reference to FIG. 7*c*.

LIST OF REFERENCE NUMERALS

| | |
|---|---|
| 1 | vial |
| 2 | cylindrical side wall |
| 3 | bottom |
| 4 | neck portion |

-continued

| LIST OF REFERENCE NUMERALS | |
|---|---|
| 5 | constricted neck portion |
| 6 | upper rim |
| 7 | filling opening |
| 8 | transition region/curved portion |
| 9 | vertex of base of a vial |
| 10 | supporting structure |
| 11 | carrier plate |
| 12 | aperture/receptacle |
| 13 | recess for access |
| 14 | side wall of receptacle 12 |
| 15 | retaining protrusion |
| 16 | gap |
| 17 | slope |
| 18 | front end |
| 18a | straight portion |
| 19 | connecting portion |
| 20 | upper supporting flange |
| 21 | upper side wall |
| 22 | step |
| 23 | lower sidewall |
| 24 | slot |
| 28 | pin |
| 30 | cooling surface |
| 31 | cooling finger of cooling surface 30 |
| 32 | nip to bottom 3 of container 1 |
| 33 | protrusion on cooling surface 30 |
| 34 | depression on cooling surface 30 |
| 40 | injection nozzle |
| 41 | height adjustment device |
| 42 | upper spraying device |
| 43 | lower spraying device |
| 50 | transport and packaging container |
| 51 | bottom |
| 52 | bottom sidewall |
| 53 | step |
| 54 | upper side wall |
| 55 | flange |
| lz | length of straight portion |

What is claimed is:

1. A supporting structure, comprising:

a plurality of vials, wherein each of the plurality of vials has a horizontal base, a cylindrical side wall, and an annular transition region between the horizontal base and the cylindrical side wall;

a carrier having an upper side, a lower side opposite the upper side and a plurality of receptacles into which the plurality of vials are at least partially inserted; and a retaining protrusion in each of the plurality of receptacles that protrudes into the receptacle in an inward radial direction at a lower end of the respective receptacle, wherein the retaining protrusion contacts or supports an associated vial of the plurality of vials at the transition region of the horizontal base so that the horizontal base of each vial juts out of the respective receptacle of the carrier and is accessible from the lower side of the carrier.

2. The supporting structure as claimed in claim 1, wherein the retaining protrusion has a shape that is matched to a shape and dimension of the transition region of the associated vial so that the transition region is supported by a positive-fit engagement.

3. The supporting structure as claimed in claim 1, wherein each of the plurality of vials comprise a neck portion, and wherein the carrier is configured so that the vials are not supported at the neck portion.

4. The supporting structure as claimed in claim 1, wherein the transition region of each of the plurality of vials has a radius of curvature, and wherein the retaining protrusion has a surface facing a respective transition region that is inclined toward the lower side of the carrier or is curved.

5. The supporting structure as claimed in claim 4, wherein the surface of the retaining protrusion facing the respective transition region is inclined toward the lower side of the carrier at an angle relative to a vertical axis perpendicular to a plane spanned by the carrier.

6. The supporting structure as claimed in claim 5, wherein the angle is in a range between 10 and 70 degrees.

7. The supporting structure as claimed in claim 5, wherein the angle corresponds to an angle of a tangent to the transition region.

8. The supporting structure as claimed in claim 4, wherein the surface of the retaining protrusion facing the respective transition region has a concave curve.

9. The supporting structure as claimed in claim 4, wherein the retaining protrusion has a front end with a straight portion, the straight portion extending perpendicular to a plane spanned by the carrier.

10. The supporting structure as claimed in claim 9, wherein the straight portion has an axial length in a direction perpendicular to the plane spanned by the carrier that is in a range of 0.1 to 5.0 mm.

11. The supporting structure as claimed in claim 4, wherein the radius of curvature is in a range of 1.0 to 10.0 mm, and wherein the retaining protrusion is matched to a shape of the transition region of the associated vial so that the bas of the vial juts out of the receptacles of the carrier by a distance in a range between 0.01 and 5.0 mm.

12. The supporting structure as claimed in claim 1, wherein the retaining protrusion is circumferential.

13. The supporting structure as claimed in claim 1, wherein the retaining protrusion is two retaining protrusions that are formed at the lower end of a respective receptacle at equiangular intervals, wherein the two retaining protrusions are spaced apart by gaps of a circumferential length that is smaller than a circumferential length of the two retaining protrusions.

14. The supporting structure as claimed in claim 1, wherein the receptacles are formed so that an upper end of the associated vial does not protrude beyond the upper side of the carrier.

15. The supporting structure as claimed in claim 14, wherein the receptacle is formed by a circumferential side wall and the retaining protrusion is formed integrally with the circumferential side wall at a lower end thereof.

16. The supporting structure as claimed in claim 15, further comprising: slots formed at the lower end and on opposite sides of the circumferential side wall.

17. The supporting structure as claimed in claim 1, wherein the carrier is formed as a supporting plate, in which the apertures are formed, wherein the retaining protrusions are formed integrally with the supporting plate at lower ends of the apertures.

18. The supporting structure as claimed in claim 17, wherein guiding members are provided at least in sections on the upper side of the supporting plate along edges of the apertures, which extend perpendicular to the upper side of the supporting plate for preventing a collision of vials supported in directly adjacent apertures.

19. The supporting structure as claimed in claim 1, wherein the receptacle is matched to an outer diameter of the associated vial supported therein so that radial play exists above the transition regions.

20. The supporting structure as claimed in claim 1, wherein the retaining protrusion has a vertical straight portion at an end thereof where the retaining protrusion contacts the transition region.

21. The supporting structure as claimed in claim 1, wherein the retaining protrusion contacts the transition region so that the associated vial is centered within the receptacle.

22. The supporting structure as claimed in claim 1, wherein the plurality of vials do not project above the upper side of the carrier.

23. A supporting structure comprising:

a vial, wherein the vial has a horizontal base, a cylindrical side wall, and an annular transition region between the horizontal base, and the cylindrical side wall, and an annular transition region between the horizontal base and the cylindrical side wall;

a carrier having an upper side, a lower side that is opposite to the upper side, and a plurality of receptacles into which the vial van be at least partially inserted so that the vial is supported at the carrier; and a plurality of retaining protrusions, one each in each of the plurality of receptables, wherein each of the plurality of retaining protrusions protrudes inwardly in a radial direction into an associated receptacle at a lower end of the associated receptacle, so that the vial, when in the receptable, is supported at the transition region, and so that the horizontal base of the vial juts out of the associated receptacle and is accessible from the lower side of supporting structure.

24. A transport or packaging container, comprising:

a box-shaped transport or packaging container; and a supporting structure accommodated in the box-shaped transport or packaging container for supporting the plurality of vials inside the transport or packaging container, the supporting structure comprising:

a plurality of vials, wherein each of the plurality of vials has a horizontal base, a cylindrical side wall, and an annular transition region between the horizontal base and the cylindrical side wall;

a carrier having an upper side, a lower side opposite the upper side and a plurality of receptacles into which the plurality of vials are at least partially inserted;

a retaining protrusion that protrudes into a respective receptacle of the plurality of receptacles in an inward radial direction at a lower end of the respective receptacle;

wherein the retaining protrusion contacts or supports an associated vial of the plurality of vials at the transition region of the horizontal base so that the horizontal bases of the plurality of vial juts out of the respective receptacle of the carrier and is accessible from the lower side of the carrier.

25. The transport or packaging container as claimed in claim 24, wherein the plurality of vials are supported on the supporting structure.

26. A method of concurrently supporting a plurality of vials using a supporting structure, comprising:

selecting a supporting structure that comprises a carrier having an upper side, a lower side opposite to the upper side, and a plurality of apertures or receptacles, the carrier having a retaining protrusion that protrudes into a respective aperture or receptacle at the lower end of a respective aperture or receptacle inward in radial direction;

selecting vials that have a bottom, which forms a horizontal base, a cylindrical side wall, and an annular transition region between the horizontal base and the cylindrical side wall; and inserting the vials, at least partially, into the apertures or receptacles so that the retaining protrusion contacts the transition region of the respectively associated vial, so that the transition regions of the vials are supported outside the horizontal bases in such a manner that the bottoms or horizontal bases of the vials jut out of the apertures or receptacles of the carrier and are freely accessible from the lower side of the carrier.

27. A method for the treatment of vials, comprising:

providing a supporting structure having an upper side, a lower side opposite to the upper side, and a plurality of apertures or receptacles, the supporting structure having a retaining protrusion that protrudes into the respective aperture or receptacle at a lower end of a respective aperture or receptacle inward in radial direction;

providing a plurality of vials, wherein the vials have a bottom, which forms a horizontal base, a cylindrical side wall, and an annular transition region between the horizontal base and the cylindrical side wall;

disposing the vials in the apertures or receptacles of the supporting structure so that the retaining protrusion contacts a vial at the transition region outside the horizontal bases in such a manner that the bottoms or horizontal bases of the vials jut out of the apertures or receptacles of the carrier and are freely accessible from the lower side of the carrier; and treating the vials while being supported at the supporting structure and while being accommodated in the apertures or receptacles.

28. The method as claimed in claim 27, wherein the treating step is a process selected from the group consisting of freeze-drying or lyophilization of a substance inside the vials; axially displacing the vials in the apertures or receptacles by fluid flow acting on the vials; cleaning of outer surfaces of the vials by fluid flowing into the apertures or receptacles; drying the outer surfaces of the vials by a gas flow flowing into the apertures or receptacles of the supporting structure; and any combinations thereof.

29. The method as claimed in claim 27, wherein the treating step comprises freeze-drying or lyophilization of a substance for pharmaceutical or medical applications inside the vials, wherein the freeze-drying or lyophilization comprises:

disposing the supporting structure together with the vials supported by it on a cooling surface so that the bottoms or horizontal bases of the vials rest directly on the cooling surface; and lyophilizing the substance for pharmaceutical or medical applications inside the vials, wherein the vials continue to be accommodated in the apertures or receptacles during lyophilization while the bottoms or horizontal bases of the vials rest directly on the cooling surface.

30. The method as claimed in claim 29, wherein the apertures or receptacles of the supporting structure are formed by circumferential side walls, wherein the vials are completely accommodated in the apertures or receptacles, wherein interspaces are formed between the side walls of directly adjacent apertures or receptacles of the supporting structure into which cooling fingers protrude which surround the apertures or receptacles of the supporting structure at least in sections.

31. The method as claimed in claim 29, wherein the carrier is formed as a supporting plate, in which the apertures or receptacles are formed, wherein the retaining protrusions are formed integrally with the supporting plate at lower ends of the apertures or receptacles, wherein the lower side of the supporting plate rests directly on the cooling surface.

32. The method as claimed in claim 29, wherein:

the bottoms of the vials are flat and the bottoms are in full surface contact with the cooling surface during lyophilization; or the bottoms of the vials are concavely curved or flat and a gap is formed between the cooling surface and the associated bottoms of the vials during lyophilization; or the bottoms of the vials are concavely curved and respectively rest on convex projections on the cooling surface.

33. The method as claimed in claim 27, wherein the treating step comprises axially displacing the vials in the apertures or receptacles by the action of fluid flow, wherein the axially displacing comprises:

ejecting fluid from nozzles or tubes disposed below the vials and centered with the respective aperture or receptacle in a direction perpendicular to a plane spanned by the carrier so that the fluid acts on the bottoms or horizontal bases of the vials to lift the vials inside the apertures or receptacles by a distance smaller than an axial length of the vials.

34. The method as claimed in claim 27, wherein the treating step comprises axially displacing the vial in the apertures or receptacles by the action of fluid flow, wherein the axially displacing comprises discharging fluid from nozzles or tubes that are disposed above the vials and centered with the respective aperture or receptacle in a direction perpendicular to a plane spanned by the carrier so that the fluid acts on upper ends of vials to push the vials down inside the apertures or receptacles to push the vials out of the apertures or receptacles.

35. The method as claimed in claim 27, wherein the treating step comprises cleaning the outer surfaces of the vials by fluid flow, wherein the cleaning step further comprises spraying fluid by a spraying device that is below and/or above the apertures or receptacles and in alignment with the apertures or receptacles so that outer surfaces of the vials are cleaned by the fluid.

36. The method as claimed in claim 35, wherein the fluid is sprayed as a liquid or liquid mist from the lower side into the apertures or receptacles, wherein the vials are lifted inside the apertures or receptacles by the spraying of the liquid and are temporarily not supported on the retaining protrusions.

37. The method as claimed in claim 27, wherein the treating step comprises the step of drying the outer surfaces of the vials further comprises:

spraying gas into the apertures or receptacles at least from the lower side of the supporting structure for drying outer surfaces of the vials, wherein the vials are lifted in the apertures or receptacles by the spraying of the gas and are temporarily not supported on the retaining protrusions.

38. The method as claimed in claim 27, wherein the step of disposing the vials in the apertures or receptacles comprises one of:

inserting the vials into the apertures or receptacles vertically from the upper side of the carrier;

inserting the vials into the apertures or receptacles vertically from the lower side of the carrier under elastic deformation of the retaining protrusions;

inserting the vials into the apertures or receptacles vertically from the lower side of the carrier under elastic deformation of side walls of the apertures or receptacles; and inserting the vials into the apertures or receptacles vertically from the lower side of the carrier under elastic deformation of the retaining protrusions and of side walls of the apertures or receptacles.

* * * * *